US006471346B2

(12) United States Patent
Kishida et al.

(10) Patent No.: US 6,471,346 B2
(45) Date of Patent: Oct. 29, 2002

(54) LIQUID CONTAINER FOR INK JET HEAD

(75) Inventors: Hajime Kishida, Tokyo; Ken Tsuchii, Sagamihara, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/891,542

(22) Filed: Jun. 27, 2001

(65) Prior Publication Data

US 2001/0035899 A1 Nov. 1, 2001

Related U.S. Application Data

(62) Division of application No. 09/025,432, filed on Feb. 18, 1998, now Pat. No. 6,293,660.

(30) Foreign Application Priority Data

Feb. 19, 1997 (JP) ..... 9-035058
Apr. 30, 1997 (JP) ..... 9-112714

(51) Int. Cl.[7] ..... B41J 2/175
(52) U.S. Cl. ..... 347/86
(58) Field of Search ..... 347/84–87, 43, 347/100, 96

(56) References Cited

U.S. PATENT DOCUMENTS

| | | | | |
|---|---|---|---|---|
| 5,182,579 A | | 1/1993 | Haruta et al. | 347/87 |
| 5,485,188 A | | 1/1996 | Tochihara et al. | 347/43 |
| 5,781,213 A | * | 7/1998 | Ujita et al. | 347/86 |
| 5,790,158 A | | 8/1998 | Shinada et al. | 347/86 |
| 6,164,772 A | * | 12/2000 | Koitabashi et al. | 347/86 |
| 6,244,695 B1 | * | 6/2001 | Udagawa | 347/86 |
| 6,286,945 B1 | * | 9/2001 | Higuma et al. | 347/86 |
| 2002/0012033 A1 | * | 1/2002 | Iwanaga et al. | 347/86 |

FOREIGN PATENT DOCUMENTS

| | | | |
|---|---|---|---|
| AU | 44317/93 | | 2/1994 |
| AU | 48244/96 | | 6/1996 |
| AU | 48245/96 | | 6/1996 |
| EP | 606101 | | 7/1994 |
| EP | 646465 | | 4/1995 |
| EP | 703083 | | 3/1996 |
| EP | 709210 | | 5/1996 |
| EP | 739741 | | 10/1996 |
| JP | 60-245562 | | 12/1985 |
| JP | 4-173343 | | 6/1992 |
| JP | 7-47686 | | 2/1995 |
| JP | 7-68770 | | 3/1995 |
| JP | 7-76098 | | 3/1995 |
| JP | 07-068770 | * | 3/1995 |
| JP | 07-076098 | * | 3/1995 |
| JP | 7-101078 | | 4/1995 |
| JP | 7-137279 | | 5/1995 |
| JP | 7-314740 | | 12/1995 |
| JP | 8-39820 | | 2/1996 |
| JP | 8-132635 | | 5/1996 |

* cited by examiner

*Primary Examiner*—Judy Nguyen
(74) *Attorney, Agent, or Firm*—Fitzpatrick, Cella, Harper & Scinto

(57) ABSTRACT

An ink container has a liquid retaining member accommodation chamber for accommodating a liquid retaining member, which is in fluid communication with an ink accommodation chamber for accommodating ink through a fluid communication path. An ink introduction groove extends substantially along an entirety of an inner corner portion of a bottom wall of the ink accommodation chamber to the fluid communication path.

27 Claims, 18 Drawing Sheets

LIQUID CONTAINER FOR INK JET HEAD

This application is a division of application Ser. No. 09/025,432, filed Feb. 18, 1998, now U.S. Pat. No. 6,293, 660, issued Sep. 25, 2001.

FIELD OF THE INVENTION AND RELATED ART

The present invention relates to a liquid container for accommodating liquid to be used for recording by an ejection head (ink jet head) which forms images by ejection of droplets onto sheets.

In conventional printers, an ejection head for image formation by ejection of droplets onto sheets, can be carried on a carriage which makes reciprocal movement in a direction perpendicular to the sheet feeding direction in a plane parallel to the sheet.

In such a scanning type apparatus, the carriage is moved on a line in response to instructions, and simultaneously, the droplets are ejected in response to ejection signals to effect the image formation on the sheet, and thereafter, the sheet is fed through a predetermined distance by a feeding device, and these operations are repeated. As for the droplet ejecting type, there are a type using an electrothermal transducer element (heater) and a type using a piezoelectric element (piezoelectric), in either of which the ejections of the ink droplets are controllable by electrical signals. In the liquid droplet ejecting method using the electrothermal transducer element, an electric signal is supplied to the electrothermal transducer element so that ink adjacent the electrothermal transducer element is instantaneously boiled, and the droplet is ejected at a high speed by an abrupt growth of a bubble caused by instantaneous boiling of the ink.

Since the liquid is consumed during the image formation, the ejection head has to be always supplied with the liquid. To accomplish this there is a system, for example, wherein an ink container is provided in a main assembly of the ink jet recording apparatus, and an ink supply tube is extended from the ink container to the recording head to supply the ink with negative pressure provided by a static head difference between the ink jet head and the ink container. Such a type, however, results in bulky structure, and therefore, it is unsuitable to popular type machines from the standpoint of the size and the price.

As another system, there is a so-called liquid container carrying type wherein a liquid container which is detachably mountable relative to the ejection head carried on the carriage, and is connected to a liquid supply port of the ejection head. In this system, the liquid container is exchanged with a new one after the liquid therein is consumed up.

In such a liquid container carrying type, the ejection head is usually disposed below the liquid container. Therefore, if the liquid container has an open-to-ambience structure, a means has to be provided to produce a predetermined negative pressure to prevent the liquid from leaking out through the droplet ejection outlet (orifice) of the ejection head. Additionally, in order to stabilize the ejection property, a stable meniscus should be maintained at the droplet ejection outlet of the ejection head. In such a liquid container, the negative pressure is adjusted to a predetermined level in consideration of the static head difference between the ejection portion of the ejection head and the liquid surface in the container so as to maintain the stabilized meniscus at the ejection outlet.

Therefore, the state of the liquid in the liquid container is influential to the liquid droplet ejection performance from the ejection head.

In order to generate such negative pressure, Japanese Laid-open Patent Application No. SHO-56-67269 and Japanese Laid-open Patent Application No. SHO-59-98857, for example, propose a spring urged bladder ink container type using an ink bladder urged by a spring in an ink container. With such a type, the manufacturing step is complicated, and therefore, the manufacturing cost is high, and in addition the ink content per unit volume of the ink container, i.e., the ink holding rate, is smaller if the thickness of the container is smaller, with the result of higher running cost.

For example, Japanese Laid-open Patent Application No. HEI-2-21466 discloses a container, the inside of which is divided into a plurality of ink chambers, which in turn are communicated through a fine hole which is capable of producing a negative pressure. In this type, however, the ink does not exist at the fine hole portion depending on the orientation of the ink container, with the result of no negative pressure, or the negative pressure tends to reduce by the expansion of the air in the ink chamber due to the ambient temperature or the like, so that ink leaks relatively easily.

There is a further known system wherein an absorbing material occupies the entire inside space of the ink container, and the ink is retained by the absorbing material. The absorbing material is a liquid absorbing material in the form of a porous material such as a sponge, and it is ordinary that absorbing material has originally a size larger than the inside volume of the container, and is compressed when it is placed therein.

With such a system, the ink amount which can be actually used from the container is smaller than the total volume of the ink container since the ink amount which can be contained in the absorbing material is limited to provide the stable negative pressure to avoid the ink leakage or the like, and since the ink in the absorbing material sometimes cannot be completely used up since the absolute value of the negative pressure increases with the consumption of the ink retained in the absorbing material.

There is a further system, which is a so-called half-sponge ink container type, which increases the amount of the ink which can be consumed. An example of this is disclosed in Japanese Laid-open Patent Application No. HEI-6-40043 wherein the container includes a liquid retaining member accommodating portion accommodating a liquid retaining member for negative pressure production, and an ink accommodating portion accommodating the ink next to the liquid retaining member accommodating portion and communicating therewith through a passage. This container for ink jet printer, therefore, is provided with a liquid retaining member accommodation chamber for accommodating the liquid retaining member and the ink accommodation chamber for accommodating the ink, so that ink holding rate is improved while stabilizing the negative pressure, with a simple structure, thus accomplishing the low manufacturing cost, low running cost, highly reliable and the downsizing of the apparatus.

A detailed description will be made as to the structure of liquid containers.

FIGS. 15 and 16 show conventional liquid containers.

The container of FIG. 15 supplies the recording liquid to a wire dot head, and the liquid absorbing material 101 has a thicknesses which is different at the front side portion and the rear side portion, wherein when it is placed in the main body 102 of the container, the front side portion is compressed by the cap 103. With this structure, the capillary force provided by the liquid absorbing material 101 increases toward the liquid supply port 104 so that ink can be concentrated at the ink supply port side efficiently.

In FIG. 16, the container is integral with an ink jet head, and three chambers of the container accommodates the liquid absorbing materials 201, respectively, wherein an ejection head 203 is provided at the bottom portion of the main body 202. The liquid absorbing material 210 is press-contacted to the supply pipe 205 which is in communication with the orifices 204 of the ejection head 203 (Japanese Laid-open Patent Application No. SHO-63-87242). With such a structure, the portion of the liquid absorbing material 210 which is contacted to the supply pipe 205 is compressed, and therefore, the capillary force of the portion is larger so that ink is efficiently collected to the supply pipe 205. Japanese Laid-open Patent Application No. SHO-55-161661 discloses a structure using fiber as the absorbing material, and the configuration of the container per se is reduced toward the connecting portion to improve the supply of the ink.

FIG. 17 shows another liquid container. This is disclosed in Japanese Laid-open Patent Application No. HEI-7-125239, wherein a negative pressure producing member accommodating chamber 401 accommodating a negative pressure producing member 402 is in fluid communication with a liquid containing chamber 403 accommodating liquid 404 through a fluid communication path 405, wherein a bottom portion of the negative pressure producing member accommodating chamber 401 between the fluid communication path 405 and the liquid supply port 406 provided at the bottom portion is lowered, so that compression of the negative pressure producing member 402 is eased at the lowered portion to provide a liquid rich region 408.

The above described liquid containers involve a problem arising from the compression required for placing it in the container.

FIG. 18 is a schematic sectional view illustrating insertion of the liquid absorbing material into the main body of the container having a flat thin type rectangular parallelopiped configuration, and FIG. 19 is a schematic sectional view of the liquid container after the liquid absorbing material is placed therein.

As shown in FIG. 18, the liquid absorbing material 303 is inserted into the main body 304 of the container while compressing it in the longitudinal direction, and more particularly, it is compressed down to less than the inner longitudinal dimension of the main body 304 using compression plates 305 and 306. At this time, the compression ratio is high in the neighborhood of the compression plates 305 and 306, and it is low in the neighborhood of the center. When the liquid absorbing material 303 is placed into the main body 304 of the container with this state, this compression ratio distribution of the liquid absorbing material 303 remains at it is after it is inserted into the main body 304, as shown in FIG. 19.

With such non-uniform compression ratio, the pore sizes of the porous material are not uniform, and therefore, the capillary forces of the liquid impregnated in the absorbing material are locally different. Therefore, only the liquid at the central portion where the capillary force is small is consumed, and the liquid adjacent the container side wall surface where the capillary force is strong is left, with the result that supply performance is deteriorated, for example, the continuity of the liquid is stopped before the liquid is used up.

This problem is eased by use of the structure shown in said FIGS. 15, 16, but the non-uniform compression still exists in FIG. 15, and in the FIG. 16 structure, the compression unevenness still exists although the compression ratio adjacent the supply pipe is high. With the structure of FIG. 17, the supply of the liquid is sufficient.

In the case of the flat thin type liquid container, the size of the maximum area side of the container necessarily increases with the increase of the accommodation capacity of the liquid. The air vent of the liquid container is sealed by a sealing material so as to avoid evaporation of the liquid during the transportation or in storage. Therefore, if the liquid container which is made of thermoplastic resin material is kept under a high temperature ambience, the maximum area side which is relatively easily deformed is expanded by the internal pressure even to such an extent of plastic deformation with the result of increase of outer dimensions. As a result, the container may be unable to be mounted to the carriage particularly in the case of the downsized apparatus.

Accordingly, it is a principal object of the present invention to provide a liquid container which can stably supply the liquid as much as possible to the ejection head.

It is another object of the present invention to provide a liquid container which can be mounted to the carriage even if the outer dimension is increased due to the plastic deformation under the high temperature ambience during transportation or the like.

Since the above described half-sponge ink container type is provided with the absorbing material, the same problem arises. When the amount of the ink in the ink accommodation chamber becomes very small, the ink tends to remain at the comer portions, at the marginal areas of the bottom surface in the ink accommodation chamber or adjacent the projection, so that consumable amount of the ink reduces. When the ink remaining amount detection of the ink accommodation chamber is effected, the remaining amount detection is unstable due to the remainder ink, with the result that small printing warning may be produced prior to the appropriate timing, or that forced print stop timing may be appropriate.

It is a further object of the present invention to provide a liquid container for an ink jet recording apparatus with which a large amount of the ink can be stably supplied.

SUMMARY OF THE INVENTION

According to an aspect of the present invention, there is provided a liquid container comprising a main body for accommodating liquid contributable to image formation; a liquid absorbing material, accommodated in said main body, for holding the liquid; a liquid supply port, in said main body, for supplying the liquid toward an ejection head for the image formation; an air vent for fluid communication between said main body and an ambience; wherein a projected surface is projected toward inside of said main body at a part of an inner surface of said main body adjacent said liquid supply port.

It is preferable that said projected surface is spaced apart from narrow walls not having said supply port.

It is preferable that said main body has an outer appearance of flat thin and substantially rectangular parallelopiped configuration, and said liquid supply port is provided in a narrow side thereof, wherein said projected surface is provided at each of maximum area side walls sandwiching the side having the liquid supply port adjacent said liquid supply port.

It is preferable that an outer surface of a substantially central portion of each of maximum area side walls of said main body is recessed.

According to another aspect of the present invention, there is provided an ink container comprising a first chamber accommodating a liquid absorbing material and having a liquid supply port for supplying liquid toward an ejection head for image formation and an air vent for fluid communication with a communication; a second chamber for containing the liquid to be supplied to said first chamber, said second chamber being in fluid communication with said first chamber through a communicating portion provided adjacent a bottom portion of said main body, in use, being substantially hermetically sealed except for said communicating portion; a partition wall for separating said first chamber and second chamber and defining a top end of said fluid communication path, wherein said container has a substantially flat thin and rectangular parallelopiped configuration; and wherein a projected surface is projected toward inside of said main body at a part of an inner surface of each of lateral side of said first chamber sandwiching a side having a liquid supply port, adjacent said liquid supply port.

It is preferable that said liquid supply port is disposed in a bottom portion of said first chamber in use, and said partition wall is provided with an ambience introduction path extending from a non-end part of said partition wall to said communicating portion, and wherein said projected surface is provided between the bottom portion to a direction of a top end of said ambience introduction path.

It is preferable that said projected surface said projected surface is spaced apart from said partition wall and from a narrow walls not having said supply port.

It is preferable that an outer surface of a substantially central portion of each of maximum area side walls of said first chamber is recessed.

In the present invention, the liquid absorbing material may be of non-compression type which has been compressed to a desired compression ratio at the time of placing it into the main body of the container or of a heat compression type which has been compressed to a desired compression ratio before it is placed into the main body. The liquid contributable to the image formation may be color ink including a coloring component such as yellow, cyan, magenta or black coloring component or a liquid containing a component which reacts with the color ink.

According to the above-described first aspect of the present invention, the projected surface is effective to compress the low compression ratio of the liquid absorbing material so that compression ratio becomes relatively uniform in the longitudinal direction. Therefore, a larger amount of the liquid in the container can be used up.

During the transportation of the liquid container in which the air vent is usually sealed, the maximum area side wall tends to be expanded by the internal pressure with the possible result of the plastic deformation and therefore the expansion of the outer dimension of the container. Since, however, the outer surface is inwardly recessed in the preferred example, the maximum width (shortest dimension) can be maintained even if the maximum area side wall expands outwardly. Accordingly, the container can be mounted into a mounting space with small tolerance.

The projected surface is effective to compress the low compression ratio of the liquid absorbing material in the first chamber so that compression ratio becomes relatively uniform in the longitudinal direction. Therefore, the liquid level in the first chamber can be maintained without reaching to the wall having the supply port to ensure the liquid supply from the second chamber while permitting ambience introduction.

Since, however, the outer surface is inwardly recessed in the preferred example of this aspect, the maximum width (shortest dimension) can be maintained even if the maximum area side wall expands outwardly. Accordingly, the container can be mounted into a mounting space with small tolerance.

According to a further aspect of the present invention, there is provided an ink container, wherein a liquid retaining member accommodation chamber accommodating a liquid retaining member is in fluid communication with an ink accommodation chamber accommodating ink through a fluid communication path; wherein an ink introduction groove extending to said fluid communication path is provided in said ink accommodation chamber.

In a preferred form of this aspect of the present invention, the inclination is such that portion adjacent said second chamber is lower.

According to this aspect of the present invention, the ink introduction groove is effective to provide liquid paths between the absorbing material and the ink at various portions in the ink accommodation chamber, and therefore, the ink can be supplied to the ink retaining member accommodation chamber with certainty even when the amount of the ink in the ink accommodating chamber becomes very small.

In the preferred example, the inclination of the bottom surface of the ink accommodation chamber is effective to maintain that bottom surface of the ink accommodation chamber is horizontal or lower at the fluid communication path side, even when the ink container is mounted to the carriage, thus assisting the proper ink motion.

According to a further aspect of the present invention, there is provided an ink container comprising: a first chamber accommodating a liquid absorbing material and having a liquid supply port for supplying liquid toward an ejection head for image formation and an air vent for fluid communication with a communication; a second chamber for containing the liquid to be supplied to said first chamber, said second chamber being in fluid communication with said first chamber through a communicating portion provided adjacent a bottom portion of said main body, in use, being substantially hermetically sealed except for said communicating portion; a partition wall for separating said first chamber and second chamber and defining a top end of said fluid communication path, wherein said container has a substantially flat thin and rectangular parallelopiped configuration; and wherein a projected surface is projected toward inside of said main body at a part of an inner surface of each of lateral side of said first chamber sandwiching a side having a liquid supply port, adjacent said liquid supply port, and wherein said second chamber is provided with an ink introduction groove extending to said communicating portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

First Embodiment

Figure 1:
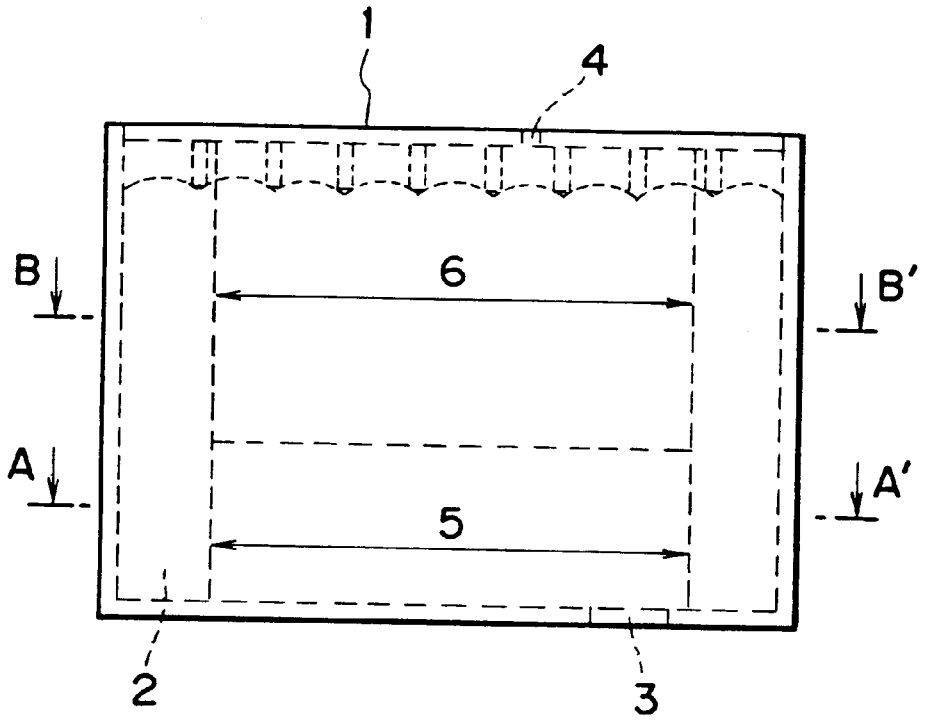
FIG. 1 is a schematic view of a liquid container according to an embodiment of the present invention.

FIG. 1 is a schematic view of a liquid container according to a first embodiment of the present invention. The liquid container of this embodiment is provided with a main body 1 of the container for accommodating the liquid contributable to the image formation, a liquid absorbing material 2 for holding the liquid in the main body 1 of the container, a liquid supply port 3 for supplying the liquid out to an ejection head (unshown) provided in a bottom portion (in use) of the main body of the container. In this embodiment, the outer appearance of the container is thin flat type rectangular parallelopiped configuration.

As shown in FIG. 1, each of side walls having the maximum area and sandwiching the wall provided with the liquid supply port 3, is provided with inwardly projected inner region (projected surface) and an inwardly recessed inner region (recessed surface). The inner projected region 5 is formed at the region at least adjacent to the liquid supply port 3 on inside surfaces of the maximum area sides. The inner projected region 5 is provided away from the narrow side which is vertical during use.

Figure 2:
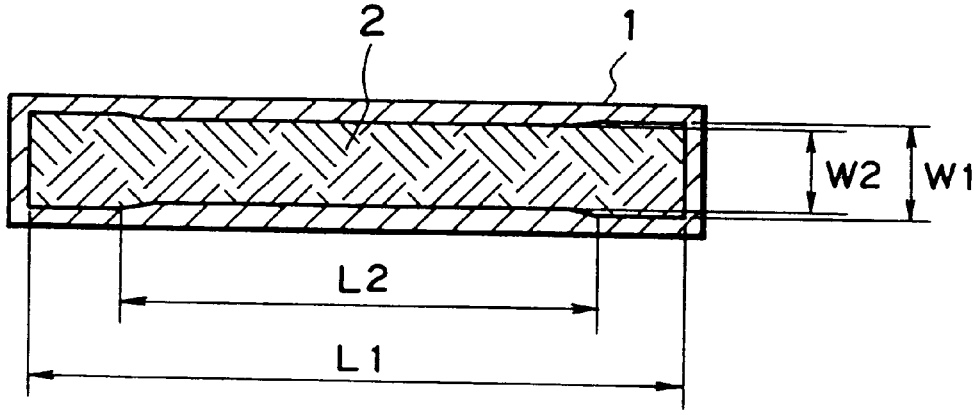
FIG. 2 is a cross-section taken along a line A–A' in the projected region of the main body of the container shown in FIG. 1.
Figure 3:
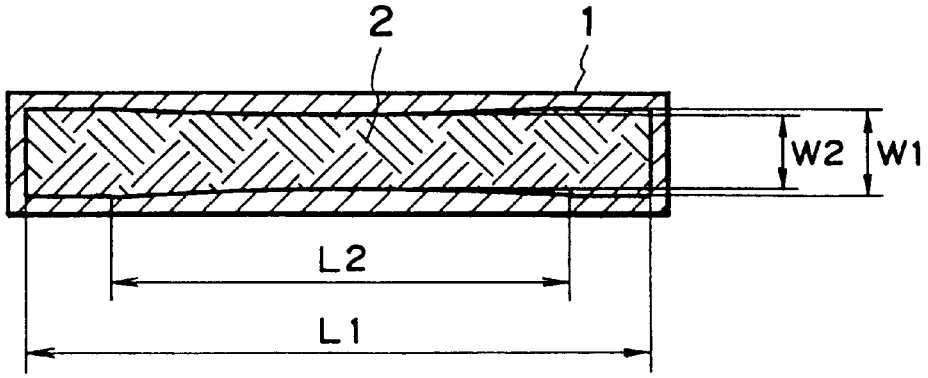
FIG. 3 is a cross-section taken along a line A–A' in the projected region of the main body of the container shown in FIG. 1 according to another example.
Figure 4:
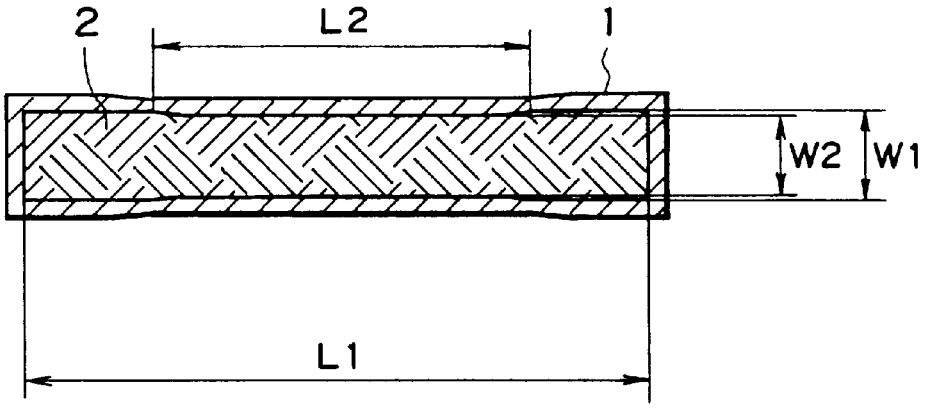
FIG. 4 is a cross-section taken along a line A–A' in the projected region of the main body of the container shown in FIG. 1 according to a further example.
Figure 5:
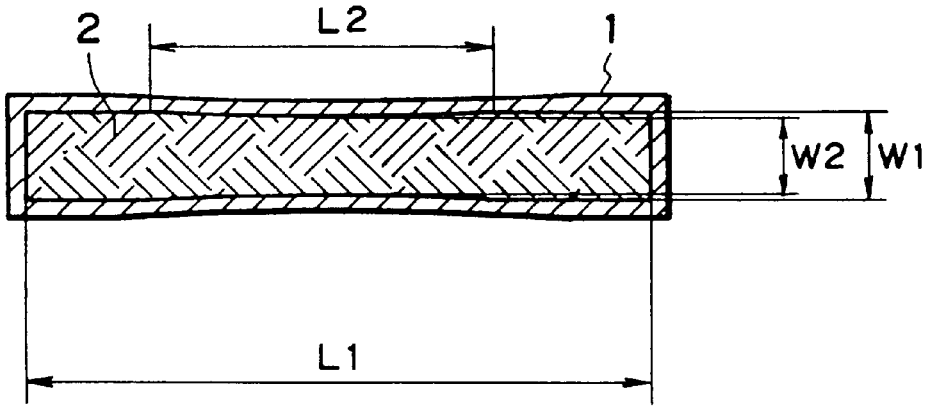
FIG. 5 is a cross-section taken along a line A–A' in the projected region of the main body of the container shown in FIG. 1 according to a yet further example.

FIGS. 2–5 show examples as sectional views of the projected regions 5 of the main body 1 of the container taken along a line A—A. The inner projected region 5 may be of trapezoidal projection formed only on the inside as shown in FIG. 2 or of projected curved surface configuration (convex) as shown in FIG. 3. Alternatively, the inside may be trapezoidal configuration without changing the thickness of the side wall as shown in FIG. 4, or may be curved as shown in FIG. 5. In this Figure, the inner projected region L2 is smaller by 40%–80% relative to the longitudinal inner dimension L1 of the main body 1 of the container, and the inner dimension W2 is smaller by 5%–20% relative to the inner widthwise dimension W1 of the main body 1 of the container.

Here, the description will be made as to the function of the inner projected region 5. As has been described in conjunction with FIGS. 18 and 19, the liquid absorbing material 2 is placed in the main body 1 of the container with the longitudinal direction dimension of the liquid absorbing material 2 being compressed to less than the inner longitudinal dimension of the main body 1. Without the inward projected portion, the compression ratio of the liquid absorbing material 2 tends to be large adjacent the narrow vertical wall (in use), and that at the central portion is small. However, according to this embodiment, the inner projected region 5 presses such a portion of the liquid absorbing material 1 as has the low compression ratio portion, but not the portion having the high compression ratio. As a result, the compression ratio distribution of the liquid absorbing material 2 is substantially uniform in the longitudinal direction. Therefore, when the ejection head (unshown) is driven so that liquid retained in the liquid absorbing material 2 is consumed toward the ejection head through the liquid supply port 3, the liquid is continuously supplied out without being left adjacent the side surfaces.

Referring back to FIG. 1, the outer recess regions 6 are inwardly recessed substantially on the outsides of the maximum area sides at the central portions except for the inner projected regions 5.

Figure 6:
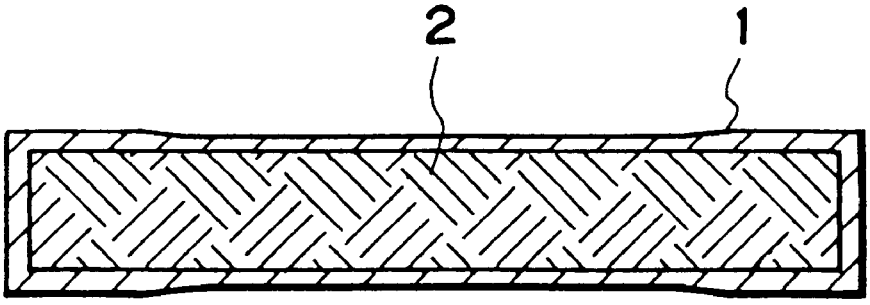
FIG. 6 is a cross-section taken along a line B–B' in the recessed region of the main body of the container shown in FIG. 1 according to an example.
Figure 7:
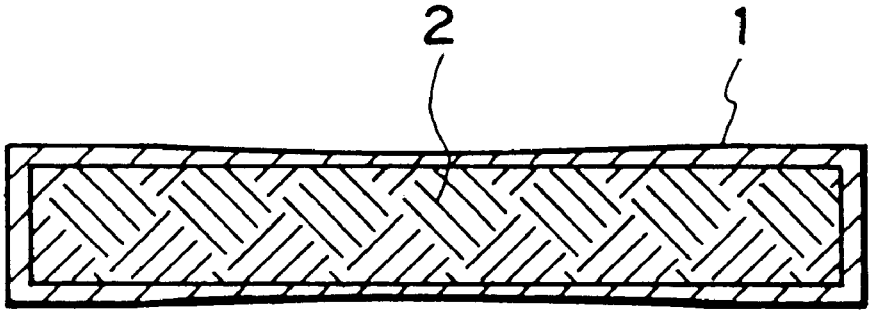
FIG. 7 is a cross-section taken along a line B–B' in the recessed region of the main body of the container shown in FIG. 1 according to another example.

FIGS. 6 and 7 are sectional views taken along a line B–B' of the outer recess region 6 of an example of the main body 1 of the container shown in FIG. 1. As for the outside recessed region 6, only the outer surface of the maximum area side is a trapezoidal recess as shown in FIG. 6, or it may be of a curved recessed configuration as shown in FIG. 7.

The description will be made as to the function of the outer recess region 6. During the transportation of the liquid container 1, an air vent 4 of the container is usually sealed by a sealing material to prevent evaporation of the liquid or the liquid leakage due to the liquid expansion in the container. When the liquid container 1 is placed or kept under a high temperature ambience during transportation, the maximum area side wall of a thermoplastic resin material, which is relatively easily deformed, may be expanded by the increased internal pressure even to the extent of the plastic deformation with the result of increase of the outer dimension. According to this embodiment, however, only the substantially central portion of the maximum area side constitutes the outside recessed region 6, and therefore, the outermost widthwise dimension remains the same even if the maximum area sides expand outwardly. Accordingly, the container can be mounted into a mounting space with small tolerance.

Second Embodiment

In the foregoing embodiment, the description has been made as to the liquid container of a so-called full sponge type wherein the liquid absorbing material occupies substantially the entire space of the container. Next, the description will be made as to an example of a liquid container of so-called half spongetype.

Figure 8:
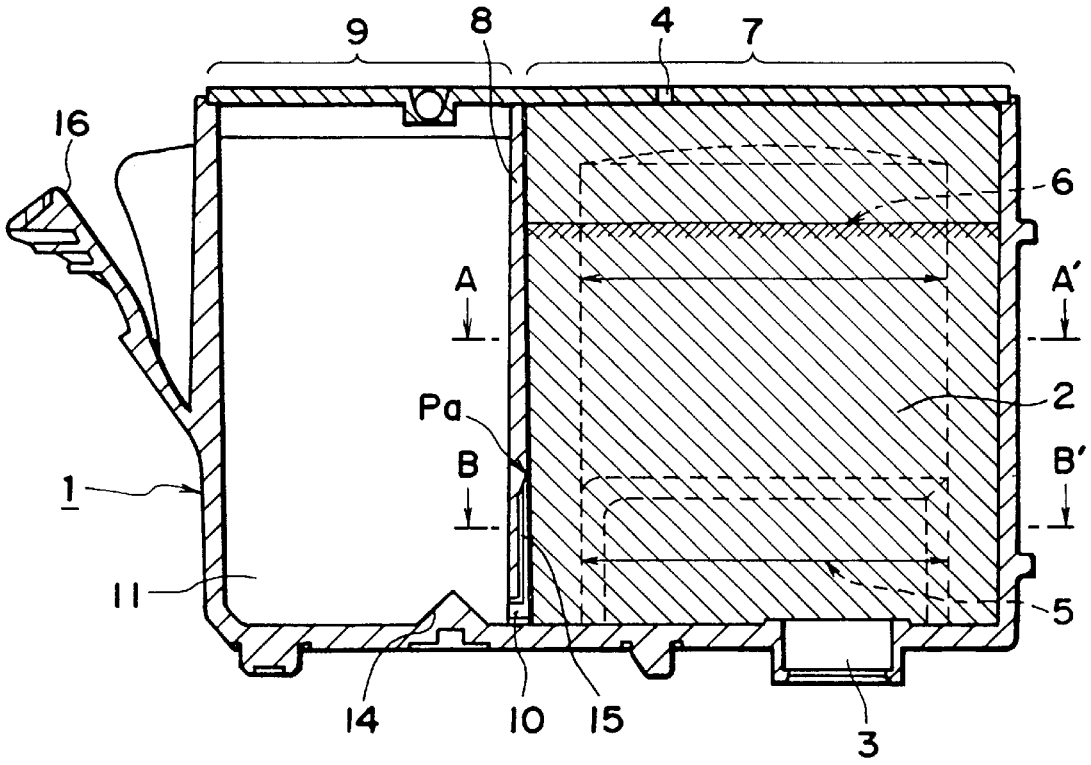
FIG. 8 is a schematic sectional view illustrating a liquid container according to another embodiment of the present invention.
Figure 9A:
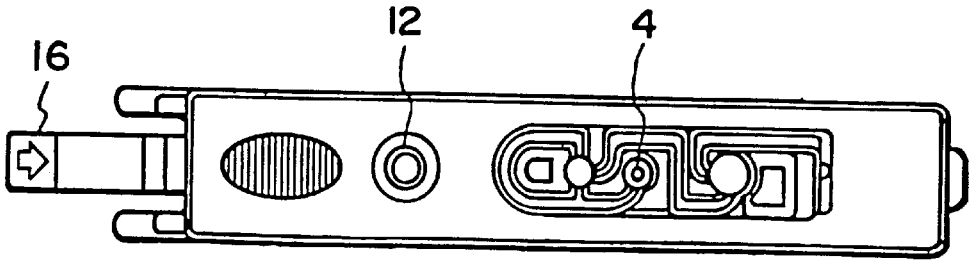
FIGS. 9(*a*) and 9(*b*) show an outer appearance of the liquid container of FIG. 8, wherein FIG. 9(*a*) is a top plan view, and FIG. 9(*b*) is partly broken side view.
Figure 9B:
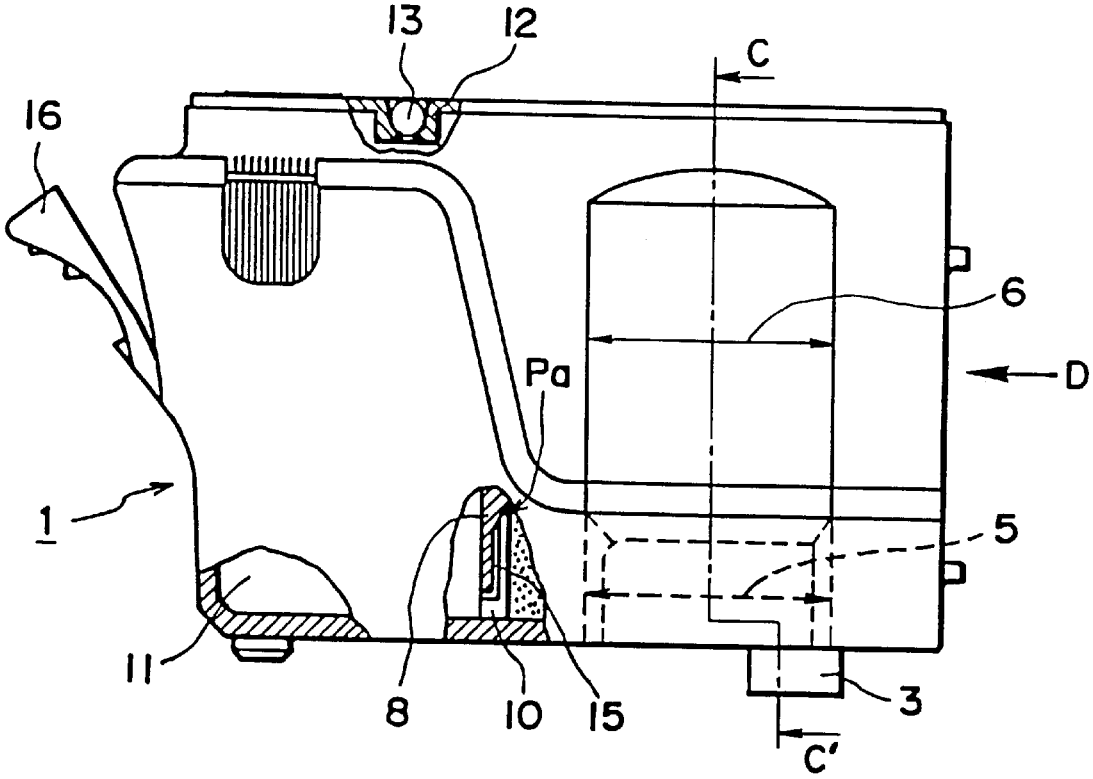
Figure 10A:
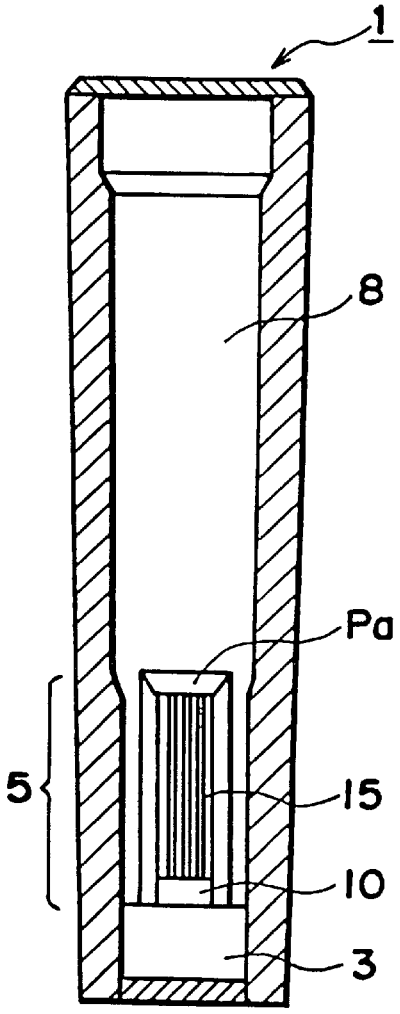
FIG. 10(*a*) is a view as seen in the direction D in FIG. 9(*b*), and FIG. 10(*b*) is a view taken along a line C–C' of FIG. 9(*b*).
Figure 10B:
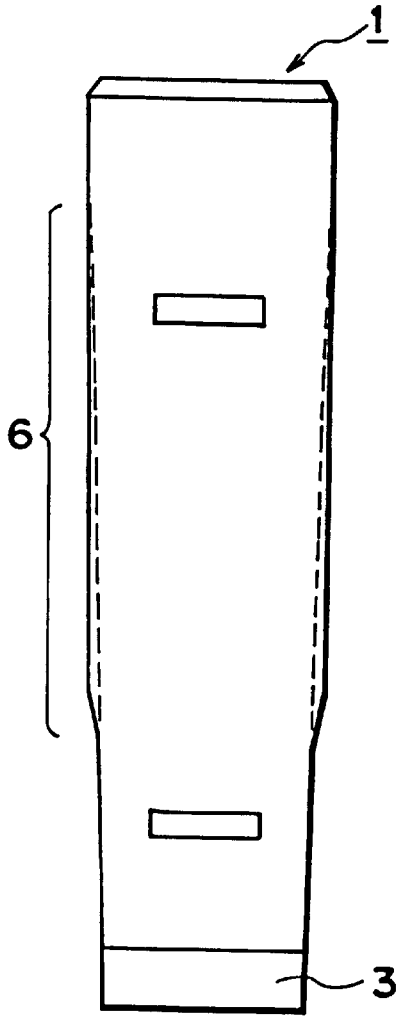

FIG. 8 is a schematic sectional view of a liquid container according to a second embodiment of the present invention. FIG. 9 provides a detailed outer appearance of the liquid container of FIG. 8. FIGS. 10(*a*) and 10(*b*) are outer appearances as seen in the direction D of FIG. 9(*b*), and a section taken along a line C–C'. The same reference numerals as in the first embodiment are assigned to the elements having the corresponding functions, and detailed descriptions thereof are omitted for simplicity.

The liquid container 1 is a container having a substantially flat thin type rectangular parallelopiped configuration. The container 1 comprises a first chamber 7 for accommodating a liquid absorbing material 2, and a second chamber 9 for accommodating liquid 11 adjacent the first chamber 7, said second chamber 9 being separated by a partition wall 8 from the first chamber 7. The bottom portion (in use) of the first chamber 7 is provided with a liquid supply port 3 for supplying the liquid toward the ejection head (unshown), and the upper portion (in use) of the first chamber 7 is provided with an air vent 4. The liquid supply port 3 may be provided with a fibrous member (press-contact member for ink discharge) to permit satisfactory discharge of the liquid. The first chamber 7 is in fluid communication with the second chamber 9 through a communicating portion 10 formed adjacent the bottom portion of the partition wall 8. The upper portion of is the second chamber 9 is provided with a liquid filling port 12 for filling the ink thereinto. The liquid filling port 12 is sealed by a ball seal 13, so that second chamber 9 is substantially hermetically sealed except for the communicating portion 10. Adjacent the communicating portion at the bottom portion of the second chamber 9, a remainder detecting portion 14 for permitting optical monitoring of the remaining amount of the liquid 11. The surface of the first chamber 7 of the partition wall 8 is provided with an ambience introduction path 15 including a groove extended toward the communicating portion 10 from non-end part thereof. Japanese Laid-open Patent Application No. HEI-6-40043 is incorporated here as to the detailed structure of the structure of the ambience introduction path 15. An outside of a narrow wall which is vertical (in use) is provided with a latch lever 16, which functions to securely engage the main body 1 of the container with the carriage (unshown).

In the first chamber 7, each of the maximum area side walls sandwiching the wall provided with the liquid supply port 3, has an inner projected region 5 and an outside recessed region 6. The inner projected region 5 is so formed that at least the region, adjacent the liquid supply port 3, of the inside of the maximum area side is projected toward the inside of the first chamber 7. The inner projected region 6 is spaced from the narrow vertical (in use) wall of the first chamber 7. The inner projected region 5 is extended from the bottom portion of the first chamber 7 to the neighborhood of the top end Pa of the ambience introduction path 15. Cross-sectional views of the container of FIG. 8 taken along a line B–B' through the inner projected region 5, are the same as that shown in FIG. 2 or 3.

On the other hand, the inner recess region 6 in the first chamber 7 is formed at the substantially central portion except for the inner projected region 5, on the outside of each of the maximum area sides, and is inwardly recessed. Cross-sectional views of the container of FIG. 8 taken along a line A–A' through the outer recessed region 5, are the same as that shown in FIG. 6 or 7.

Figure 11:
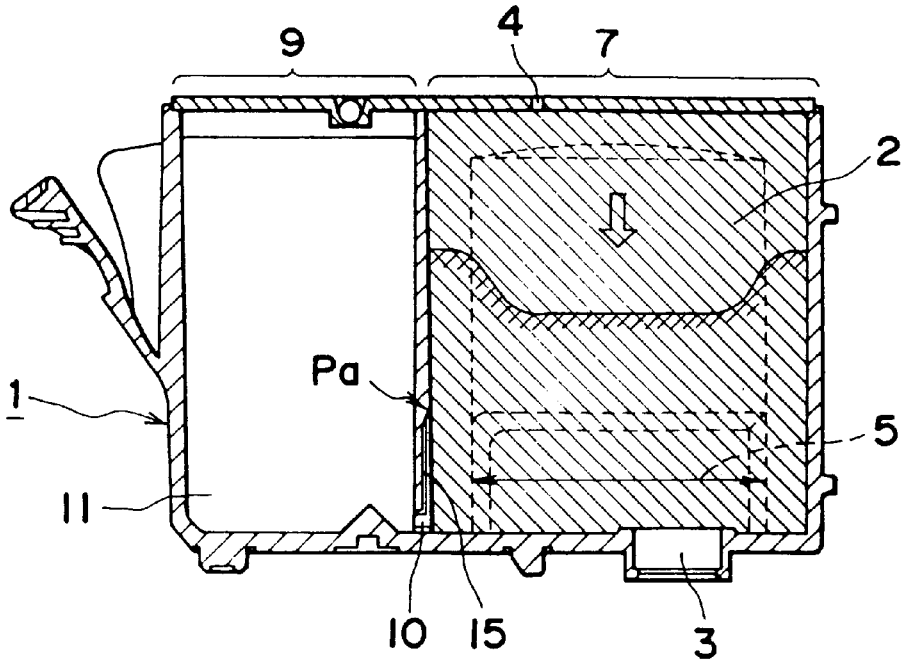
FIG. 11 illustrates consumption process of the liquid in the liquid container shown in FIG. 8.
Figure 12:
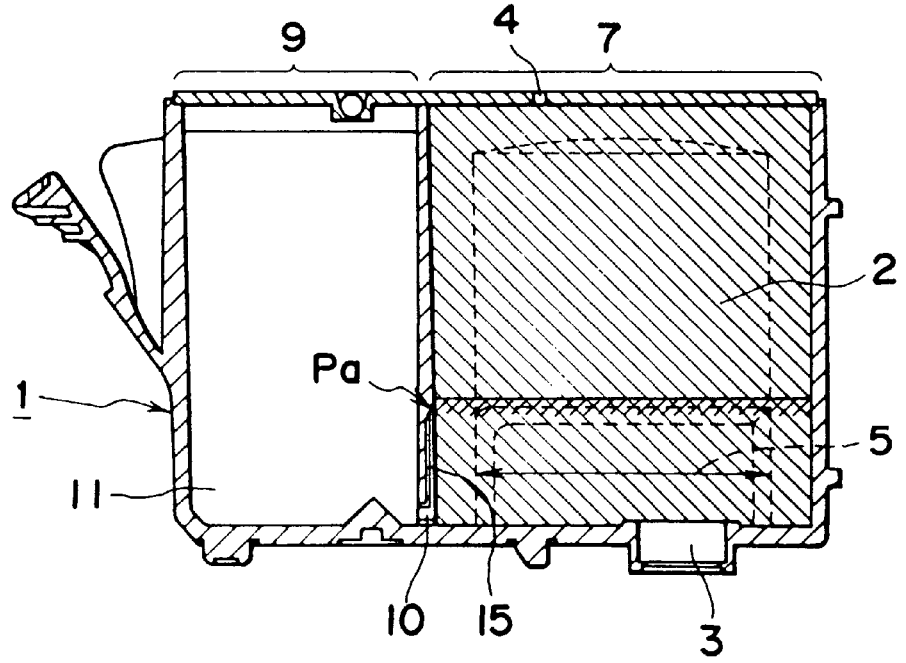
FIG. 12 illustrates consumption process of the liquid in the liquid container shown in FIG. 8.

The operation principle of the liquid container of this embodiment will be described. FIGS. 11 and 12 show the consumption process of the liquid in the liquid container 1 of FIG. 8.

Figure 18:
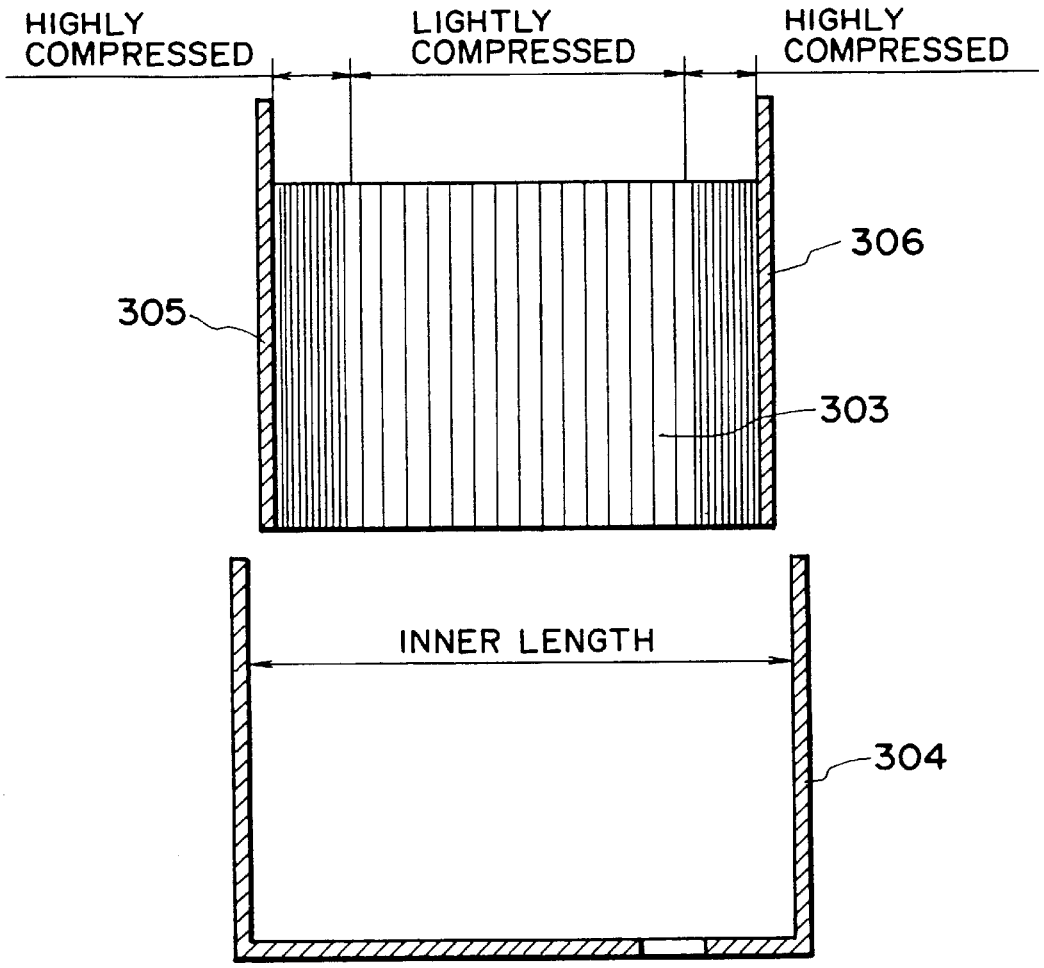
FIG. 18 is a schematic sectional view illustrating insertion of a liquid absorbing material into a main body of a flat thin type rectangular parallelopiped configuration container.
Figure 19A:
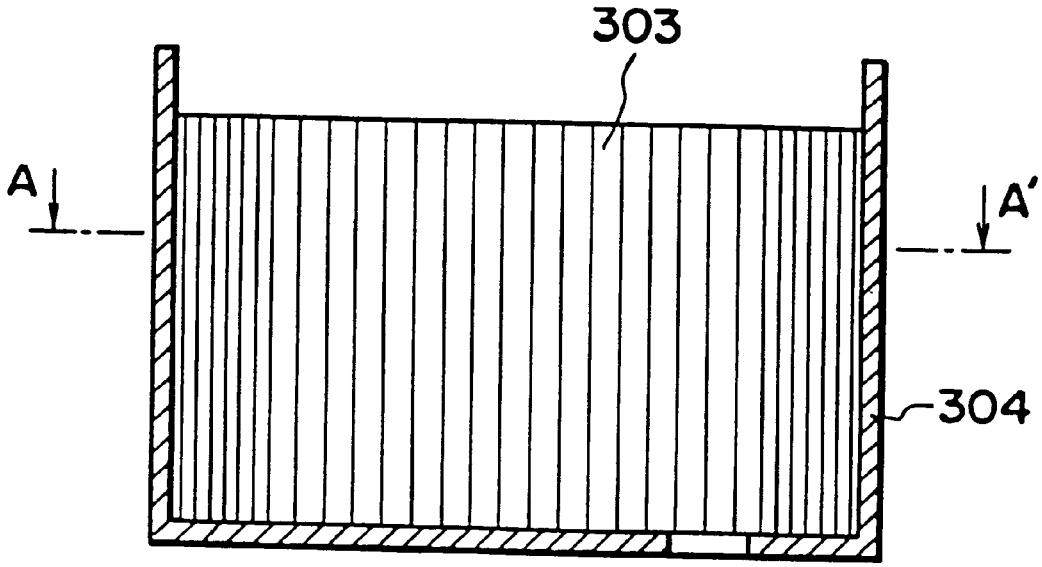
FIGS. 19(*a*) and 19(*b*) are a schematic sectional views of a liquid container of FIG. 18 after the liquid absorbing material is placed therein.
Figure 19B:
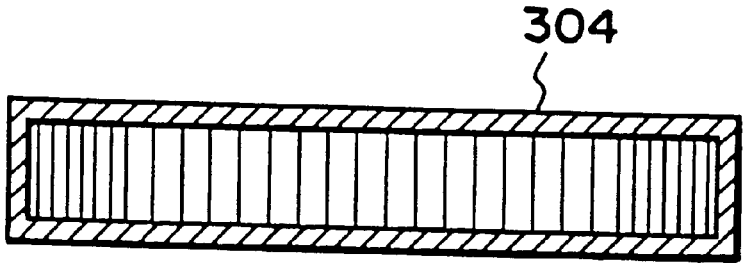

As shown in FIGS. 18 and 19, the liquid absorbing material 2 is placed in the first chamber 7 of the main body 1 of the container with the longitudinal dimension of the liquid absorbing material 2 being compressed to less than the inner longitudinal dimension of the first chamber 7 of the main body 1. As a result, after the liquid absorbing material 2 is placed in the first chamber, the compression ratio of the liquid absorbing material 2 is large adjacent the narrow vertical wall (in use), and that at the central portion is small.

If the liquid is ejected through the orifice of the ejection head (unshown), the liquid held in the liquid absorbing material 2 of the first chamber 7 is first supplied to the ejection head through the liquid supply port 3. With continued ejecting operation, the amount of the liquid in the liquid absorbing material 2 decreases due to the liquid supply (consumption). Since the compression ratio of the liquid absorbing material 2 is high adjacent the narrow vertical wall of the liquid container 1 and adjacent the partition wall 8, the liquid remains there, but only the liquid at the central portion of the first chamber 1 where the capillary force is small, is supplied out. Therefore, the liquid surface in the liquid absorbing material 2 lowers at the central portion of the first chamber 7 as shown in FIG. 11.

When the liquid is consumed from the liquid absorbing material 2, the liquid surface in the liquid absorbing material 2 reaches the inner projected region 5. The inner projected region 5 presses the liquid absorbing material 1 only at the low compression ratio portion not the high compression ratio portion thereof, so that liquid level in the central portion of the first chamber 7, particularly the lowered level rises. As a result, the liquid level in the liquid absorbing material 2 having reached the inner projected region 5 is maintained substantially constant.

Since the inner projected region 5 starts with a level substantially equal to the top end Pa of the ambience introduction path 15, the air at the liquid level in the liquid absorbing material 2 can be introduced into the second chamber 9 through the ambience introduction path 15 and through the communicating portion when the liquid level in the liquid absorbing material 2 reaches the predetermined level. At this time, the static head provided by the ejection portion of the ejection head, the reduced pressure in the second chamber 9 and the capillary force in the liquid absorbing material 2 are balanced. Since the top end of the ambience introduction path and the upper portion of the inner projected region are substantially at the same level, the introduction of the air from the ambience introduction path is stabilized, and the static head difference can be maintained constant, and therefore, the ejection of the ink through the head is also stabilized. The same level feature is preferable from the standpoint of the stabilized ink supply.

When the liquid supply (consumption) occurs from the liquid ejection outlet 3, the liquid quantity in the first chamber 7 does not reduce, and the liquid 11 in the second chamber 9 is consumed. Thus, the amount of the liquid corresponding to the liquid supply is consumed from the second chamber 9, and the corresponding amount of the ambient air is introduced into the first chamber 7 through the air vent 4, without changing the liquid distribution in the first chamber 7. As long as the liquid is consumed from the second chamber 9, the actions are repeated so that constant negative pressure is provided in the main body 1 of the container.

As soon as the liquid consumption from the second chamber 9 ends, the liquid is supplied again from the liquid absorbing material 2 in the first chamber 7. Since the density distribution of the liquid absorbing material 2 is uniform, the liquid is consumed continuously to the end through the liquid supply port 3, similarly to the first embodiment.

Figure 13:
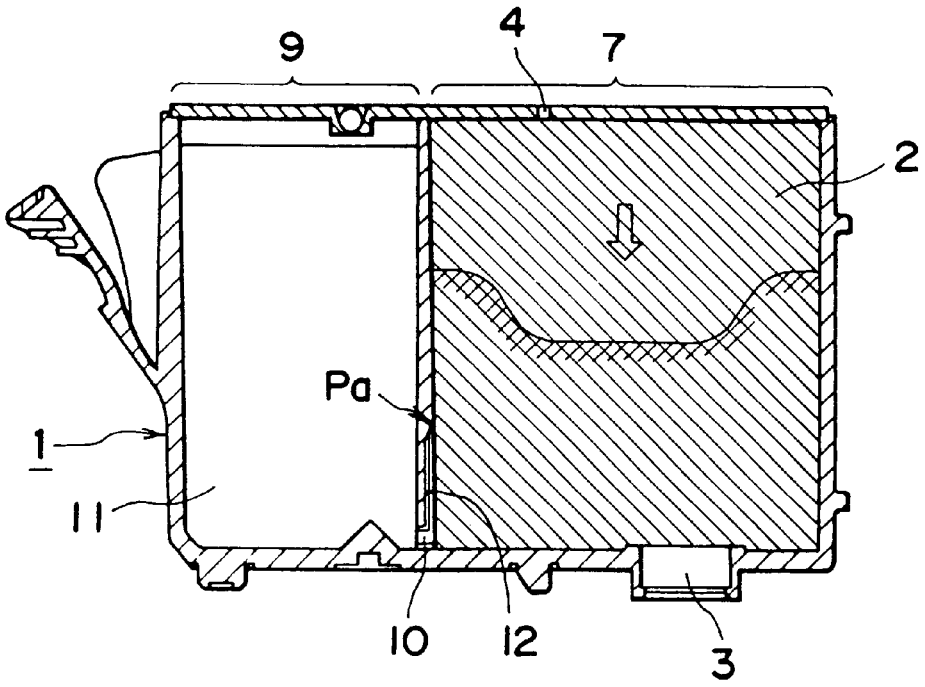
FIG. 13 illustrates consumption process when the liquid container is not provided with the inner projected region.
Figure 14:
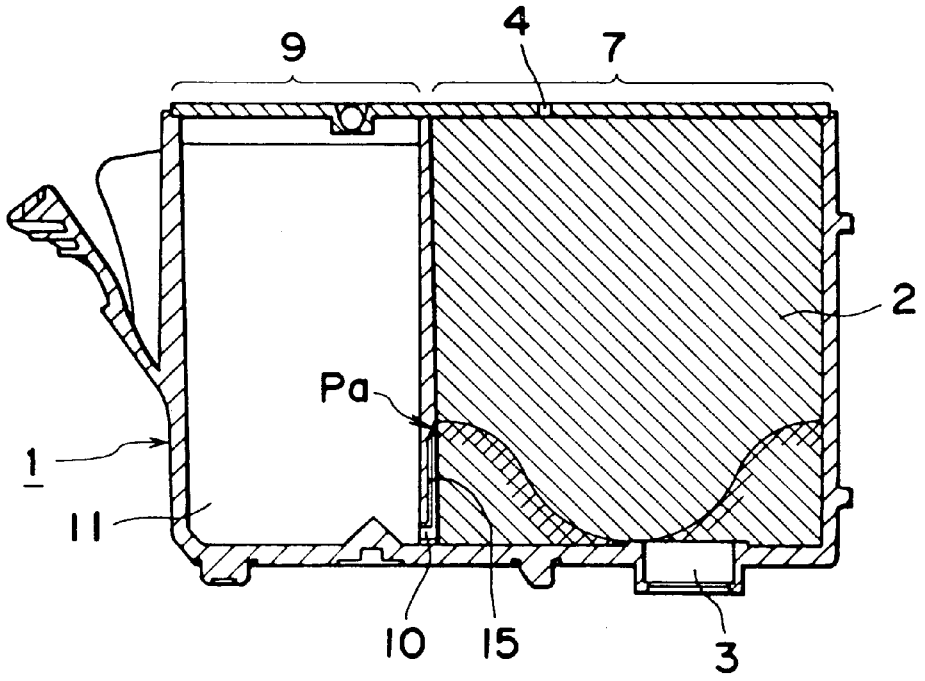
FIG. 14 illustrates consumption process when the liquid container is not provided with the inner projected region.
Figure 15:
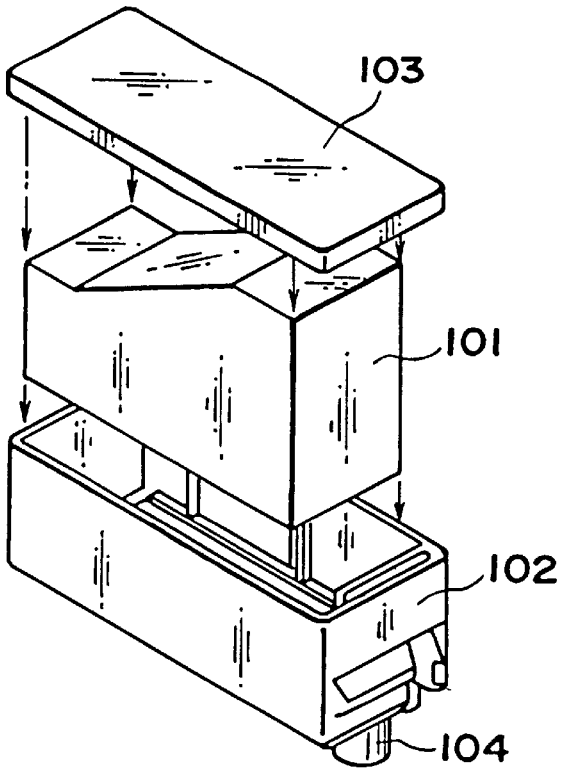
FIG. 15 PRIOR ART
FIG. 15 shows an example of a conventional liquid container.
Figure 16:
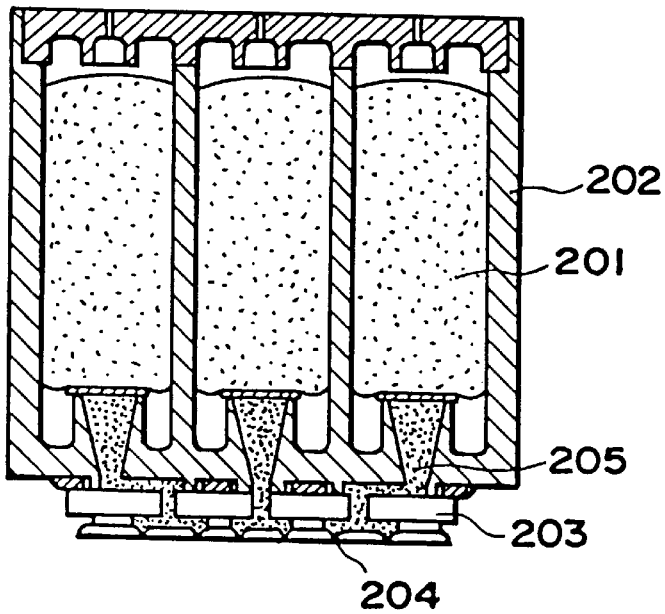
FIG. 16 PRIOR ART
FIG. 16 shows another example of a conventional liquid container.
Figure 17:
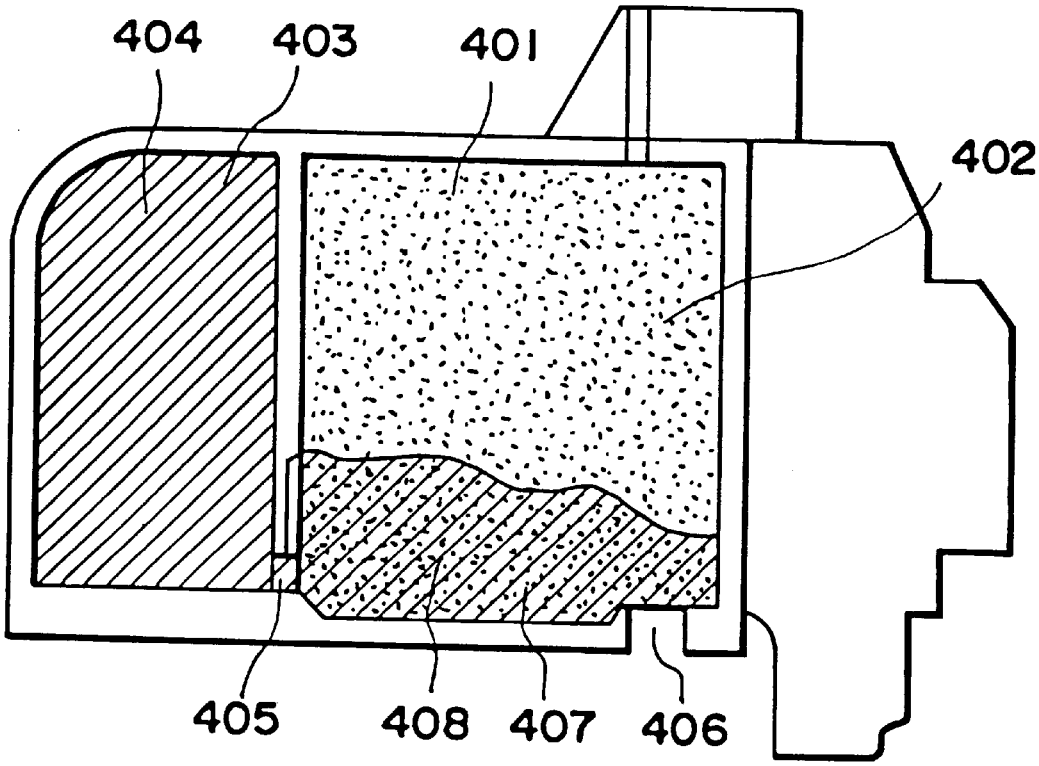
FIG. 17 PRIOR ART
FIG. 17 shows another example of a conventional liquid container.

As compared with this embodiment, the function will be described as to when the inner projected region 5 is not provided. FIGS. 13 and 14 show the consumption process of the liquid when the liquid container 1 is not provided with the inner projected region 5.

In this case, too, the compression ratio of the liquid absorbing material 2 is high adjacent the narrow vertical wall of the liquid container 1 and adjacent the partition wall 8 due to the insertion of the liquid absorbing material 2 into the first chamber 7. Therefore, with the liquid consumption, the liquid surface in the liquid absorbing material 2 lowers at the central portion of the first chamber 7 shown in FIG. 13. With the continued liquid ejection, the liquid surface at the central portion of the first chamber 7 lowers greatly, sometimes even to such an extent to reach the inner bottom surface of the first chamber 7 before the ambience adjacent to the liquid level in the liquid absorbing material 2 reaches the top end Pa of the ambience introduction path 15. Depending on the non-uniformity of the liquid absorbing material 2, the liquid may be discontinued at the bottom portion as shown in FIG. 13. If this occurs, the liquid 11 cannot be supplied from the second chamber 9 into the first chamber 7, and in addition, the air is introduced into the ejection head through the liquid supply port 3 with the result that ejection becomes unstable even to the extent of ejection failure.

According to this embodiment, however, the lowering of the liquid level with the liquid consumption at the central portion where the compression ratio is low due to the insertion of the liquid absorbing material 2, is suppressed by the inner projected region 5, thus maintaining the liquid level constant. In this manner, it can be avoided that liquid level in the liquid absorbing material 2 in the first chamber reaches the bottom portion having the liquid supply port 3 before the start of the gas-liquid exchange between the first chamber 7 and the second chamber 9 with the result of disabled introduction of the ambience to the liquid supply port, so that stabilized ejection property can be maintained.

As regards the function of the outer recess region 6 is the same as with the first embodiment. In brief, since the only the central portion of the outer surface of the maximum area side constitutes the inner recess region 6 (toward the inner side), the outermost width of the container can be maintained even if the maximum area wall expands outwardly due to the high temperature ambience occurring during transportation or the like. Accordingly, the container can be mounted into a mounting space with small tolerance.

The liquid absorbing material 2 usable with the first and second embodiments, may be of any material if it can retain the liquid despite the weight of the liquid and the small scale vibration imparted thereto. It may be cotton-like member comprising fiber net or a porous material having through pores. A sponge material such as foam polyurethane resin material is preferable since the liquid retaining force and the negative pressure production is easily adjustable. The foam is preferable since the adjustment is possible so as to provide the desired compression ratio (porosity) during the manufacturing of the liquid absorbing material. There are, for example, a heat compression type wherein the compression ratio has been controlled to a predetermined level by the heat compression treatment prior to placing into the main body of the container, and a non-compression type wherein a foam having a predetermined porosity per unit volume is cut into predetermined dimensions to provide a desired compression ratio when it is placed in the main body of the container. The problem of the compression distribution arising from the insertion of the absorbing material into the main body of the container exists both in the heat compression type and the non-compression type.

The liquid 11 contributable to the image formation, may be color ink containing a coloring component such as yellow, cyan, magenta black or the like.

In another example, before or after the image formation on the sheet material with the color ink, processing liquid may be applied to the same area, or processing liquid may be applied to the entire surface of the sheet material to improve the fixing effect of the ink on the sheet material. In such a case, the liquid 11 may be liquid containing a component reactable with the color ink. Examples of such liquid include the ones using anion or cation reaction.

As described in the foregoing, the present invention is usable with a liquid container having the main body, the liquid absorbing material accommodated in the main body, the liquid supply port, to the ejection head, provided in the main body, and an air vent for fluid communication with the ambience, with the following technical advantages. By the projected surface described above, the density distribution of the compression ratio of the liquid absorbing material when the liquid absorbing material is compressed in the longitudinal direction and inserted into the main body, is uniform. As a result, the liquid can be used up continuously without leaving it adjacent the side wall of the container.

The present invention is usable with a liquid container having substantially flat thin type rectangular parallelopiped configuration, comprising the first chamber open to ambience, the second chamber containing the liquid to be supplied to the first chamber and substantially hermetically sealed except for the communicating portion through which the first and second chambers are in fluid communication with each other, and a partition wall between the first chamber and the second chamber and extending above the communicating portion, with the following technical advantages. When the liquid absorbing material is inserted into the main body of the container while the longitudinal dimension thereof is reduced, the projected surface pressed the low compression ratio portion, not the high compression ratio portion. Therefore, the lowering of the liquid level due to the liquid consumption at the central portion where the compression ratio of the liquid absorbing material is low, can be suppressed, so that substantially constant liquid level can be maintained.

Since the projected surface is substantially at the same level as the top end of the ambience introduction path, the ambience adjacent to the liquid surface is enabled to be in fluid communication with the second chamber through the ambience introduction path and the communicating portion at the time when the liquid level in the liquid absorbing material reaches a predetermined level. In this manner, it can be avoided that liquid level in the liquid absorbing material 2 in the first chamber reaches the bottom portion having the liquid supply port 3 before the start of the gas-liquid exchange between the first chamber 7 and the second chamber 9 with the result of disabled introduction of the ambience to the liquid supply port, so that stabilized ejection characteristics can be maintained.

As soon as the liquid consumption in the second chamber, the liquid in the liquid absorbing material in the first chamber is consumed again, and the liquid can be consumed continuously from the liquid supply port since the compression ratio distribution is made uniform by the inner projected region.

Since the only the central portion of the outer surface of the maximum area side constitutes the inner recess region 6 (toward the inner side), the outermost width of the container can be maintained even if the maximum area wall expands outwardly due to the high temperature ambience occurring during transportation or the like. Accordingly, the container can be mounted into a mounting space with small tolerance.

The structure of the second chamber according to an embodiment of the present invention will be described.

Figure 20A:
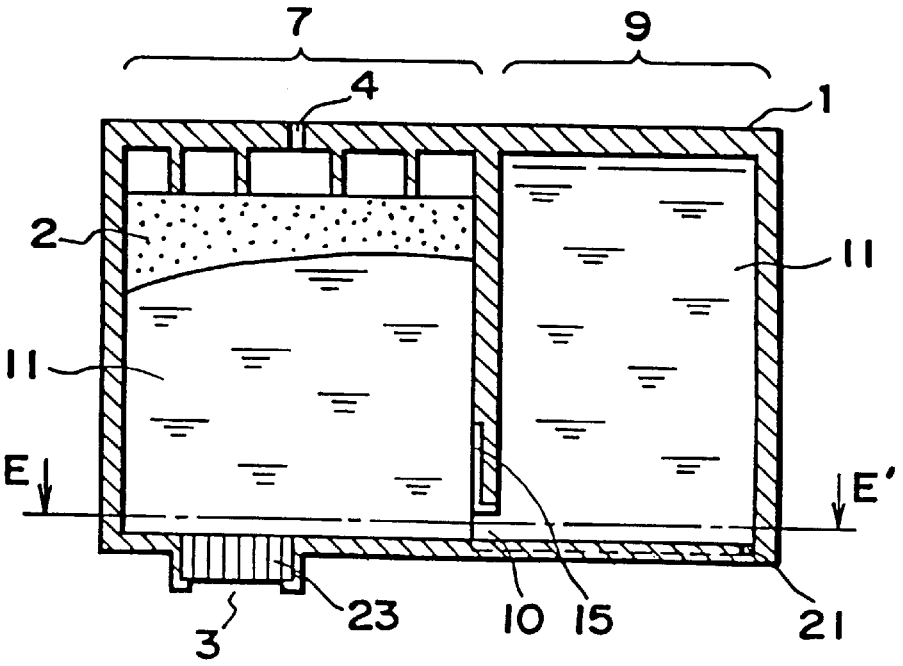
FIG. 20 is a schematic view of a second chamber according to an embodiment of the present invention, wherein FIG. 20(*a*) is a cross-sectional view, and FIG. 20(*b*)is a sectional view taken along a line E—E, and FIG. 20(*c*) is a sectional view taken along a line F—F.
Figure 20B:
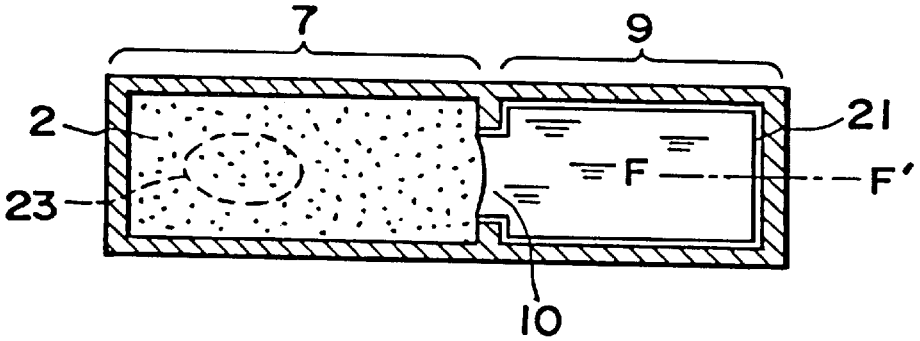
Figure 20C:
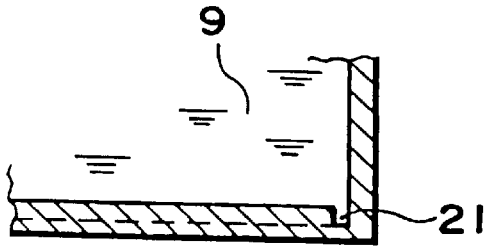

FIG. 20 shows an ink container using a structure of the second chamber (ink accommodation chamber) according to this embodiment. FIG. 20(*a*) is a vertical cross-section taken at a substantially longitudinal center, and FIG. 20(*b*) is a sectional view taken along a line E—E, and FIG. 20(*c*) is a sectional view taken along a line F–F' .

In FIG. 20, designated by reference numeral 1 is a half-sponge ink container; 7 is a liquid retaining member accommodation chamber for accommodating a liquid retaining member 2 having a liquid absorption property, such as urethane sponge; 9 is an ink accommodation chamber for accommodating liquid (ink) 11; 4 is an air vent for introducing the ambience into the liquid retaining member accommodation chamber 7; 11 indicated by hatched portions is ink therein; 23 is a press-contact member of a fibrous member such as PP (polypropylene) or felt. To the press-contact member, a filter portion at the end of an ink receiving tube of the recording head is contacted to supply the ink to the recording head.

Further, designated by 3 is an ink supply port into which the filter is inserted; 10 is a fluid communication path for fluid communication between the liquid retaining member accommodation chamber 7 and the ink accommodation chamber 9; 15 is an ambience introduction groove for introducing the ambience into the ink accommodation chamber 9 when the ink in the liquid retaining member 2 is used to a predetermined level; and 21 is an ink introduction groove which is peculiar to this embodiment.

The ink introduction groove 21 is, as shown in FIG. 20(*c*), provided as a groove at the peripheral portion of the bottom surface of the ink accommodation chamber 9, and as shown in FIG. 20(*b*), it encloses the bottom surface of the ink accommodation chamber 9, and connects to the liquid retaining member 2 through the fluid communication path 10.

Because of this structure, the ink 11 at the peripheral portion or the comer portion of the bottom surface of the ink accommodation chamber 9 is absorbed in the liquid retaining member 2 through the ink introduction groove 21, the amount of the remainder ink in the ink accommodation chamber 9 without being used, is significantly reduced.

By reducing the capillary force of the ink introduction groove 21 to less than the capillary force of the liquid retaining member 2, the ink 11 in the ink introduction groove 21 can be completely absorbed, so that usage efficiency of the ink 11 is further improved. In addition, by reducing the cross-sectional area of the ink introduction groove 21 is reduced toward the fluid communication path 10, the ink can be positively moved, and therefore, this is preferable.

Figure 21A:
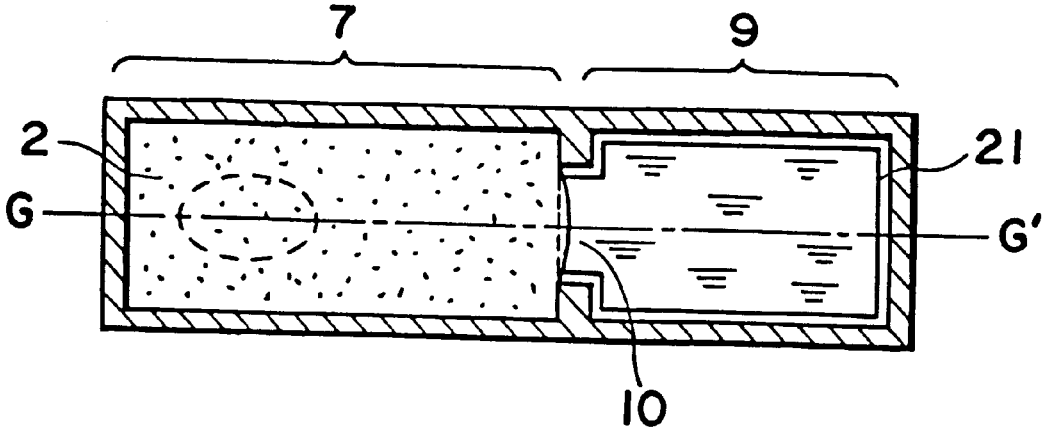
FIG. 21 is a schematic view of a second chamber according to a further embodiment of the present invention, wherein FIG. 21(*a*) is a sectional view, and FIG. 21(*b*) is a sectional view taken along a line G—G.
Figure 21B:
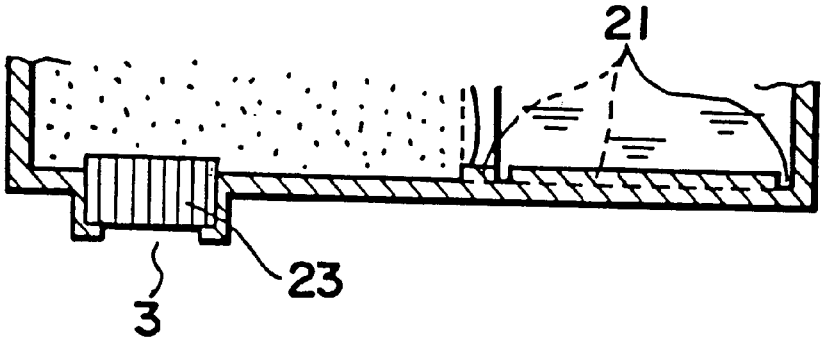

FIGS. 21(*a*) and 21(*b*) are views corresponding to FIG. 1(*b*) and a sectional view taken along a line G–G', respectively. In the embodiment of FIG. 20, the bottom levels of the liquid retaining member accommodation chamber 7 and the ink accommodation chamber 9 are the same, and the ink introduction groove 21 ends at the fluid communication path 10. In this embodiment, however, the level of the bottom surface of the liquid retaining member accommodation chamber 7 is lowered to the level of the bottom level of the ink introduction groove 21, so that ink introduction groove 21 does not end at the fluid communication path 10, and therefore, it continues to the liquid retaining member accommodation chamber 7.

Because of this structure, the ink absorption into the liquid retaining member 2 through the ink introduction path 21 is further stabilized. The latitude of the mold division for the manufacturing is increased.

Figure 22A:
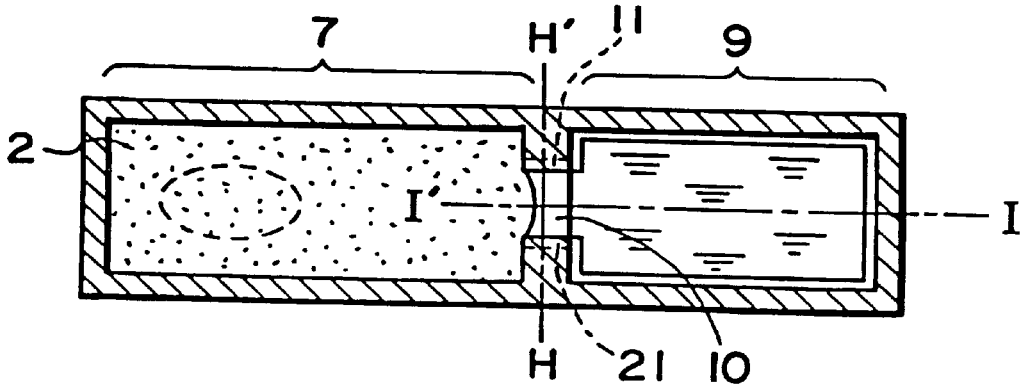
FIG. 22 is a schematic view of a second chamber according to a further embodiment, wherein FIG. 22(*a*) is a sectional view, FIG. 22(*b*) is a sectional view taken along a line H—H, and FIG. 22(*c*) is a sectional view taken along a ling I—I.
Figure 22B:
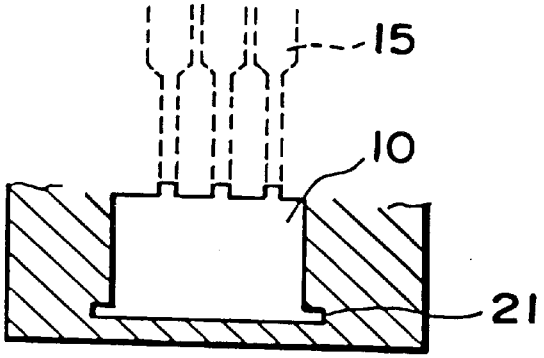
Figure 22C:
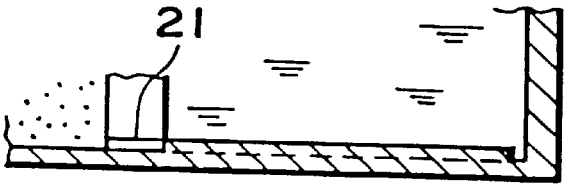

FIG. 22 shows a further embodiment wherein FIG. 22(*a*) shows a view corresponding to said FIG. 21(*a*), FIG. 22(*b*) is a sectional view taken along a line H—H, and FIG. 22(*c*) is a sectional view taken along a line I–I'.

In the embodiments of FIGS. 20 and 21, the recess constituting the ink introduction groove 21 is provided only in the bottom surface, but in this embodiment, the recess is formed in the side of the fluid communication path 10 to constitute the ink introduction groove 21.

In order to maintain the connection between the ink accommodation chamber 9 and the ink introduction groove 21, the bottom surface of the fluid communication path 10 is lower than the bottom surface of the ink accommodation chamber 9 as shown in FIG. 22(*c*).

Thus, the liquid retaining member 2 assuredly enters the ink introduction groove 21, and the absorption of the ink through the ink introduction groove 21 is stabilized.

The latitude of the mold division is increased.

Figure 23A:
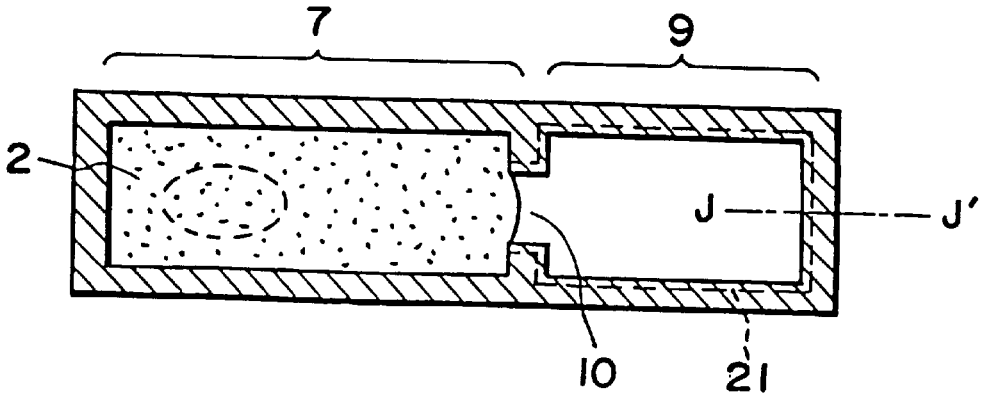
FIG. 23 is a schematic view of the second chamber according to a further embodiment of the present invention, wherein FIG. 23(*a*) is a sectional view, and FIG. 23(*b*) is a sectional view taken along a line J—J.
Figure 23B:
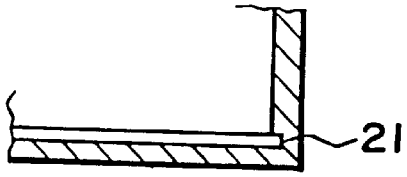

FIG. 23 shows this embodiment, wherein FIG. 23(*a*) shows a view corresponding to the FIG. 22(*a*), and FIG. 23(*b*) shows a sectional view taken along a line J–J'.

In the embodiment of FIG. 22, the recess is formed only in the fluid communication path 10 to constitute the ink introduction groove 21, but in this embodiment, the recess is formed also in the side surface of the ink accommodation chamber 9.

By doing so, the connection property between the ink accommodation chamber 9 and the ink introduction groove 21 of the fluid 5 communication path 10 is improved, so that stability of the ink suction-out from the ink accommodation chamber 9 through the ink introduction groove 21 is stabilized.

The ink introduction groove 21 in the side surface may be constituted by a projection.

Figure 24:
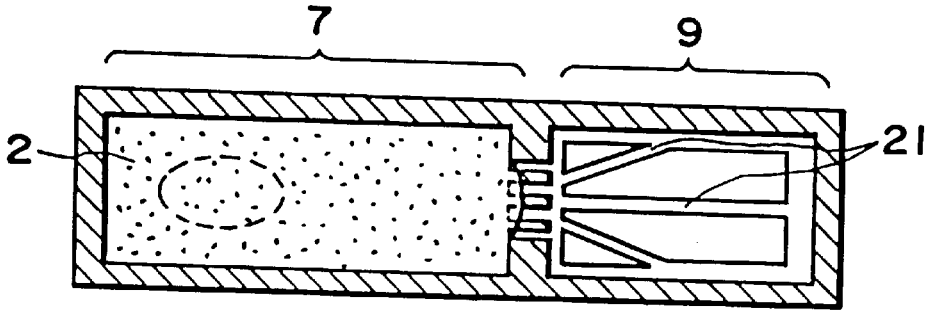
FIG. 24 is a schematic sectional view of the second chamber according to a further embodiment of the present invention.

FIG. 24 is an illustration according to a further embodiment, and show a view corresponding to said FIG. 23(*a*).

In the embodiments of FIGS. 20–23, the ink introduction path 21 is provided only in the circumference of the ink accommodation chamber 9, but in this embodiment, a plurality of ink introduction grooves 21 are provided in the bottom surface of the ink accommodation chamber. By doing so, the stability of the ink sucking out is further improved.

Figure 25A:
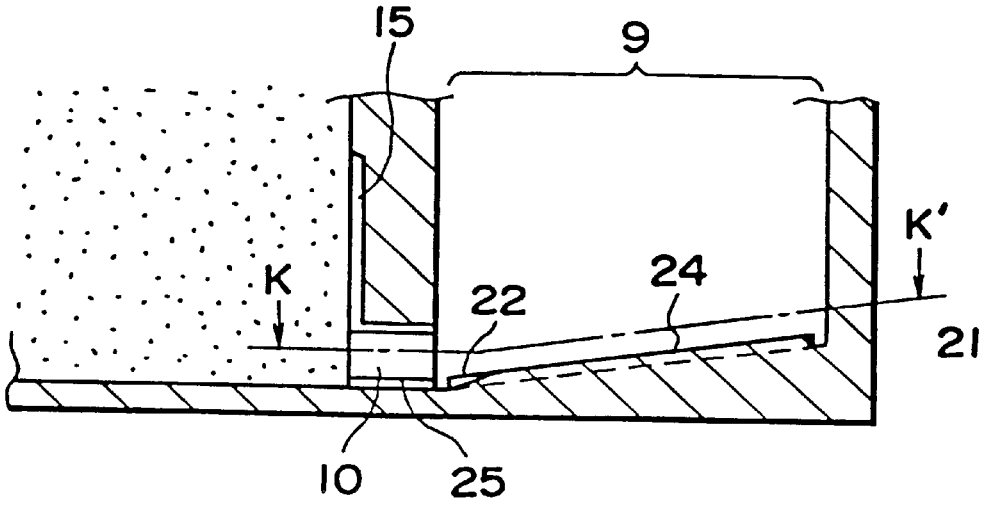
FIG. 25 is a schematic view of the second chamber according to a further embodiment of the present invention, wherein FIG. 25(*a*) is a partially sectional view, FIG. 25(*b*) is a sectional view taken along a line K—K.
Figure 25B:
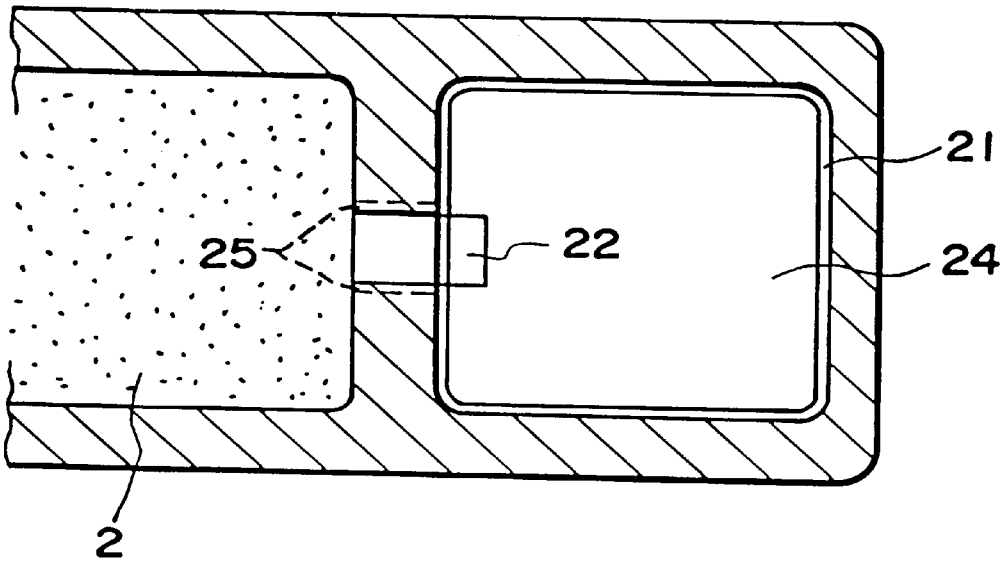

FIG. 25 illustrates a further embodiment, wherein FIG. 25(*a*) is a cross-sectional view showing a bottom surface configuration of the ink container according to this embodiment, and FIG. 25(*b*) is a top plan view of the internal structure.

In this embodiment, the ink introduction groove 21 is used, and in addition, the bottom surface of the ink accommodation chamber 9 is inclined, so that even if the recording head is mounted to the carriage with some inclination, it is assured that fluid communication path 10 is lower to some extent, and therefore, the ink in the ink accommodation chamber 9 flows into the fluid communication path 10 by gravity.

As shown in FIG. 25(*a*) (cross-sectional view) and FIG. 25(*b*) which is a sectional view taken along a line K–K', the ink accommodation chamber 9 has an inclined surface 24 lowering toward a fluid communication path 10 for fluid communication with the liquid retaining member accommodation chamber 7. By the provision of the inclined surface 24, the liquid can be properly introduced to the fluid communication path 10. In addition, in this example, there is provided an ink introduction groove 21 formed as a recess along a bottom portion of the outermost circumference of the ink accommodation chamber 9. The ink introduction groove 21 functions, as described hereinbefore, to introduce the ink from the ink accommodation chamber 9 into the fluid communication path 10.

The circumference portion of the bottom surface of the ink accommodation chamber 9 has a larger capillary force than at the bottom surface flat surface portion, so that ink tends to remain. Particularly, the comer portion where the walls intersect, has a larger capillary force, and therefore, the ink tends to remain. At the final stage of the ink consumption, the liquid passage to the liquid retaining member is discontinued, and the ink flow ends while the ink remains at the comer portion or the peripheral portion. Thus the ink remains in the ink accommodating chamber undesirably. Therefore, it is preferable that ink introduction groove 21 is formed at the comer portion and the circumference portion of the bottom of the ink accommodating chamber 9, and that it is extended along the bottom surface circumference to assure the fluid communication with the liquid retaining member accommodation chamber 7.

The ink introduction groove 21 is connected with the groove 25 provided in the side surface of the wall constituting the fluid communication path 10 at the fluid communication path 10. By doing so, a continuous groove region is constituted over the ink introduction groove 21 of the ink accommodation chamber 9 and the liquid retaining member accommodation chamber 7.

As shown in FIG. 21, the bottom surface of the ink accommodation chamber 9 is at a level higher than the bottom surface of the liquid retaining member accommodation chamber 7, and in order to assure the continuity of the surface from the bottom surface of the ink accommodation chamber 9 to the fluid communication path 10, there is provided a second inclined surface 22 having an inclination angle different from that of the main inclined surface 24 of the ink accommodation chamber. It is for maintaining the continuity between the bottom surface of the ink accommodation chamber 3 and the surface of the fluid communication path 10, and by using this, there is no part which impede the movement of the ink, thus further reducing the remaining amount of the ink.

It is preferable that comer portion of the ink accommodation chamber 9 is formed into a curved surface. If the comer portion has an acute angle, a capillary force may be produced with the result of retaining a small amount of the ink. The structure of the bottom surface of the ink accommodation chamber 9 is not limited to those described in the foregoing, and the entire inclination may be toward the fluid communication path 10, and the ink introduction groove 21 shown in FIG. 24 may be provided.

The structure of the groove 25 provided at each of the sides of the fluid communication path 10 is not limited to those described above, and may be in the form of a recess at the bottom side; alternatively, the recess is not inevitable if the comer constituting the fluid communication path 10 is enough to produce the capillary tube force. The ink introduction path 11 may by converged toward the fluid communication path 8 stepwisely. Then, the ink can be supplied properly toward the liquid retaining member accommodation chamber.

By employing the above-described structure, the ink can be moved smoothly from the ink chamber to the fluid communication path portion, and therefore, the ink in the ink accommodation chamber can be further smoothly supplied.

As described in the foregoing, the provision of the ink introduction groove is effective to reduce the amount of the ink which remains unusably in the ink accommodation chamber to increase the usage efficiency of the ink, thus reducing the running cost.

When the ink remaining amount detection is effected for the ink accommodation chamber, the remaining amount detection is stabilized, since the amount of the remaining is very small, thus avoiding damaging the print data. The warning is correct, and the printing operation may be forcedly stopped.

By the provision of inclination of the bottom surface of the ink accommodation chamber, the ink can be assuredly sucked out from the ink accommodation chamber even when the ink container is mounted to the carriage inclinedly, so that amount of the unusably remaining ink can be reduced, thus increasing the usage efficiency of the ink, and reducing the running cost.

When the ink remaining amount detection is effected for the ink accommodation chamber, the remaining amount detection is stabilized, since the amount of the remaining is very small, thus avoiding damaging the print data. The warning is correct, and the printing operation may be forcedly stopped.

Figure 26:
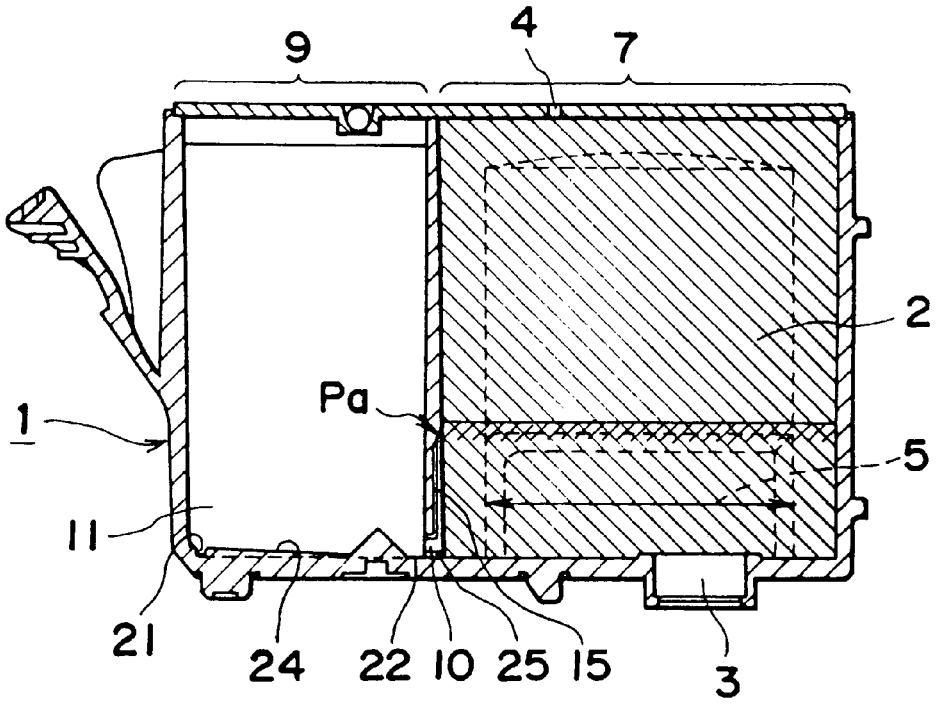
FIG. 26 is a schematic sectional view of a container according to a further embodiment of the present invention.

FIG. 26 shows a further embodiment.

In this embodiment, there are provided the ink introduction groove 21, the main inclined surface 24, the second inclined surface 22 and the groove 25 as shown in FIG. 25, as the structure around the fluid communication path 10 and the ink accommodation chamber 9. The structure of the liquid retaining member accommodation chamber 7 is as shown in FIG. 9. The description of each of the structures is omitted for simplicity.

Using these structures, even when the amount of the ink in the ink accommodation chamber 9 becomes very small, the combination of the main inclined surface 24 and the ink introduction groove 21 permits the smooth movement of the ink toward the communicating portion 10, and the combination of the groove 25 and the second inclined surface 22 provided at the region of the communicating portion 10 permits the movement of the small amount of the remaining ink toward the liquid retaining member accommodation chamber 7.

On the other hand, at the liquid retaining member accommodation chamber 7, the static head for the head can be properly maintained to accomplish the stabilized ink supply, because of the provision of the inner projected region constituting the stable ink region. As regards the ink, the state of the liquid retaining member in the inner projected region is quite uniform so that amount of the remaining ink can be extremely reduced.

Therefore, this embodiment accomplishes the stable ink supply and the high use efficiency of the ink.

While the invention has been described with reference to the structures disclosed herein, it is not confined to the details set forth and this application is intended to cover such modifications or changes as may come within the purposes of the improvements or the scope of the following claims.

What is claimed is:

1. An ink container, wherein a liquid retaining member accommodation chamber accommodating a liquid retaining member is in fluid communication with an ink accommodation chamber accommodating ink through a fluid communication path, the improvement comprising:

an ink introduction groove extending along substantially an entirety of an inner corner portion, in use, of a bottom wall of said ink accommodation chamber, to said fluid communication path.

2. A container according to claim 1, wherein said ink introduction groove is provided by a recess in a bottom inner side or a lateral inner side of said ink accommodation chamber.

3. A container according to claim 1, wherein said ink introduction groove is provided by a projection on a bottom inner or a lateral inner side of said ink accommodation chamber.

4. A container according to claim 1, wherein said ink introduction groove is contacted to said liquid retaining member.

5. A container according to claim 1, wherein a capillary force of said ink introduction groove is smaller than a capillary force of said liquid retaining member.

6. A container according to claim 1, wherein a bottom surface of said ink accommodation chamber is inclined.

7. A container according to claim 6, wherein the inclination is such that a portion adjacent said liquid retaining member accommodation chamber is lower.

8. A container according to claim 1, wherein said ink introduction groove becomes narrower toward said fluid communication path.

9. A container according to claim 1, wherein said ink introduction groove extends continuously into said liquid retaining member accommodation chamber.

10. A container according to claim 1, wherein a plurality of such ink introduction grooves are provided in a surface of said bottom wall.

11. An ink container comprising:

a first chamber accommodating a liquid absorbing material and having a liquid supply port for supplying liquid toward an ejection head for image formation and an air vent for fluid communication with ambient atmosphere;

a second chamber for containing the liquid to be supplied to said first chamber, said second chamber being in fluid communication with said first chamber through a communicating portion provided adjacent a bottom portion, in use, of said ink container, said second chamber being substantially hermetically sealed except for said communicating portion;

a partition wall for separating said first chamber and second chamber and defining a top end of said communicating portion, wherein said ink container has a substantially flat thin and rectangular parallelopiped configuration; and wherein a projected surface is projected toward an inside of said ink container at a part of an inner surface of each of maximum area lateral sides of said first chamber sandwiching a side having said liquid supply port, said projected surface adjacent said liquid supply port, and wherein said second chamber is provided with an ink introduction groove extending along substantially an entirety of an inner corner portion, in use, of a bottom wall of said second chamber to said communicating portion.

12. A container according to claim 11, wherein said liquid supply port is disposed in a bottom portion of said first chamber in use, and said partition wall is provided with an ambience introduction path extending from a non-end part of said partition wall to said communicating portion, and wherein said projected surface is provided between the bottom portion to a direction of a top end of said ambience introduction path.

13. A container according to claim 11, wherein an outer surface of a substantially central portion of each of the maximum area lateral sides of said first chamber is recessed.

14. A container according to claim 11, wherein said projected surface is spaced apart from said partition wall and from a narrow wall not having said supply port and opposed to said partition wall.

15. A container according to claim 11, wherein said liquid absorbing material is a non-compression type member which is compressed to a desired compression ratio when it is placed in said main body.

16. A container according to claim 11, wherein said liquid absorbing material is a heat compression type member which has been compressed substantially to a desired compression ratio before it is placed in main body.

17. A container according to claim 11, wherein the liquid is color ink including at least a yellow, cyan, magenta or black coloring component.

18. A container according to claim 11, wherein the liquid contains a component reactable with color ink including at least a yellow, cyan, magenta or black coloring component.

19. A container according to claim 11, wherein said ink introduction groove is provided by a recess in a bottom or lateral inner side of said second chamber.

20. A container according to claim 11, wherein said ink introduction groove is provided by a projection on a bottom surface or a lateral side of said second chamber.

21. A container according to claim 11, wherein said ink introduction groove is contacted to said liquid absorbing material.

22. A container according to claim 11, wherein a capillary force of said ink introduction groove is smaller than a capillary force of said liquid absorbing material.

23. A container according to claim 11, wherein a bottom surface of said second chamber is inclined.

24. A container according to claim 23, wherein the inclination is such that a portion adjacent said first chamber is lower.

25. A container according to claim 11, wherein said ink introduction groove becomes narrower toward said communicating portion.

26. A container according to claim 11, wherein said ink introduction groove extends continuously into said first chamber.

27. A container according to claim 11, wherein a plurality of such ink introduction grooves are provided in a surface of said bottom wall.

* * * * *

UNITED STATES PATENT AND TRADEMARK OFFICE

CERTIFICATE OF CORRECTION

PATENT NO. : 6,471,346 B2
DATED : October 29, 2002
INVENTOR(S) : Hajime Kishida et al.

It is certified that error appears in the above-identified patent and that said Letters Patent is hereby corrected as shown below:

Column 2,
Line 62, “thicknesses” should read -- thickness --.

Column 3,
Line 53, “at” should read -- as --.

Column 4,
Line 30, “comer” should read -- corner --; and
Line 32, “that” should read -- that a --.

Column 5,
Line 27, “said projected surface” should be deleted; and
Line 29, “walls” should read -- wall --.

Column 7,
Line 18, “is” should read -- is a --;
Line 41, “are a” should read -- are --; and
Line 57, “ling” should read -- line --.

Column 8,
Line 21, “is” should read -- is a --; and
Line 25, “with” should read -- with an --; and Column 9,
Line 36, “spongetype” should read -- sponge type --.

Column 12,
Line 25, “be” should read -- be a --.

Column 13,
Line 39, “the” (first occurrence) should be deleted.

Column 15,
Lines 58, 63 and 66, “comer” should read -- corner --.

Column 16,
Line 24, “comer” should read -- the corner --;
Lines 26 and 37, “comer” should read -- corner --; and
Lines 49 and 63, “unusably” should read -- unusable --.

UNITED STATES PATENT AND TRADEMARK OFFICE

CERTIFICATE OF CORRECTION

PATENT NO. : 6,471,346 B2
DATED : October 29, 2002
INVENTOR(S) : Hajime Kishida et al.

It is certified that error appears in the above-identified patent and that said Letters Patent is hereby corrected as shown below:

Column 17,
Line 1, “remaining” should read -- remaining ink --.

Column 18,
Line 61, “in” should read -- in a --.

Signed and Sealed this

Twenty-second Day of April, 2003

JAMES E. ROGAN
*Director of the United States Patent and Trademark Office*